US012727644B2

(12) United States Patent
Frank et al.

(10) Patent No.: US 12,727,644 B2
(45) Date of Patent: Sep. 8, 2026

(54) ARTICLE OF FOOTWEAR WITH EXTENDED PLATE FOR TOE-OFF

(71) Applicant: NIKE, Inc., Beaverton, OR (US)

(72) Inventors: Nick S. Frank, Portland, OR (US); Robert Mervar, Portland, OR (US); Kort W. Neumann, IV, Portland, OR (US); Rachel M. Savage, Beaverton, OR (US); Matthew Tegenkamp, Portland, OR (US); Jenni Westphal, Beaverton, OR (US); Bryan K. Youngs, Beaverton, OR (US)

(73) Assignee: NIKE, Inc., Beaverton, OR (US)

( * ) Notice: Subject to any disclaimer, the term of this patent is extended or adjusted under 35 U.S.C. 154(b) by 0 days.

(21) Appl. No.: 19/226,635

(22) Filed: Jun. 3, 2025

(65) Prior Publication Data

US 2025/0288054 A1 Sep. 18, 2025

Related U.S. Application Data

(62) Division of application No. 17/957,248, filed on Sep. 30, 2022, now Pat. No. 12,349,760.

(60) Provisional application No. 63/285,537, filed on Dec. 3, 2021.

(51) Int. Cl.

| | |
|---|---|
| ***A43B 13/12*** | (2006.01) |
| ***A43B 13/37*** | (2006.01) |
| ***A43B 13/42*** | (2006.01) |

(52) U.S. Cl.

CPC ..... *A43B 13/127* (2013.01); *A43B 13/122* (2013.01); *A43B 13/37* (2013.01); *A43B 13/42* (2013.01)

(58) Field of Classification Search

CPC ..... A43B 13/127; A43B 13/122; A43B 13/37; A43B 13/42

See application file for complete search history.

(56) References Cited

U.S. PATENT DOCUMENTS

| | | | | |
|---|---|---|---|---|
| 1,726,198 A * | 8/1929 | Stahl | A43B 5/025 36/83 |
| 2,089,316 A | 8/1937 | Whelton | |
| 2,090,770 A | 8/1937 | Whelton | |
| 3,561,141 A | 2/1971 | Brown | |
| 4,186,500 A * | 2/1980 | Salzman | A43B 5/0411 280/615 |
| 4,247,996 A * | 2/1981 | Grapin | A63B 21/4015 482/79 |

(Continued)

*Primary Examiner* — Alissa L Hoey
*Assistant Examiner* — Akwokwo Olabisi Redhead
(74) *Attorney, Agent, or Firm* — Shook, Hardy & Bacon L.L.P.

(57) ABSTRACT

An article of footwear includes an upper and a sole structure. The sole structure includes a plate that has a heel portion, a midfoot portion, a forefoot portion, and an extension portion. The extension portion extends forward of the forefoot portion and forward of a foremost extent of upper. The plate includes a first plate layer establishing an outer surface of the plate and extending in each of the heel portion, the midfoot portion, the forefoot portion, and the extension portion, and a second plate layer interfacing with the first plate layer and extending in the forefoot portion and the extension portion. A bending stiffness of the second plate layer is greater than a bending stiffness of the first plate layer.

20 Claims, 17 Drawing Sheets

(56) References Cited

U.S. PATENT DOCUMENTS

| | | | | |
|---|---|---|---|---|
| 4,811,504 | A * | 3/1989 | Bunke | A43B 5/0419 36/25 R |
| 6,202,326 | B1 * | 3/2001 | Hauglin | A43B 13/12 36/117.3 |
| 9,144,265 | B2 | 9/2015 | Lubart | |
| 9,950,486 | B2 * | 4/2018 | Hartmann | A43B 7/144 |
| 12,096,823 | B1 * | 9/2024 | Glancy | A43B 5/185 |
| 2009/0064538 | A1 * | 3/2009 | Roether | A43B 13/026 36/25 R |
| 2017/0071286 | A1 * | 3/2017 | Kilgore | A43C 15/02 |
| 2017/0340055 | A1 * | 11/2017 | Schneider | A43B 13/184 |
| 2019/0365039 | A1 * | 12/2019 | Auyang | A43B 13/39 |
| 2020/0154831 | A1 * | 5/2020 | Hopkins | A43B 13/12 |
| 2022/0022595 | A1 * | 1/2022 | Girard | A43B 13/183 |

* cited by examiner

ARTICLE OF FOOTWEAR WITH EXTENDED PLATE FOR TOE-OFF

CROSS-REFERENCE TO RELATED APPLICATION

This application is a divisional of U.S. Nonprovisional application Ser. No. 17/957,248, filed Sep. 30, 2022, which claims the benefit of priority to U.S. Provisional Application No. 63/285,537 filed Dec. 3, 2021, and both of which are hereby incorporated by reference in their entirety.

TECHNICAL FIELD

The present disclosure generally relates to an article of footwear having a plate with an extension portion for toe-off.

BACKGROUND

Footwear typically includes a sole structure configured to be located under a wearer's foot to space the foot away from the ground or floor surface. A sole structure can be designed to provide a sufficient level of cushioning, support, and traction for a particular athletic endeavor.

BRIEF DESCRIPTION OF THE DRAWINGS

The drawings described herein are for illustrative purposes only, are schematic in nature, and are intended to be exemplary rather than to limit the scope of the disclosure.

DESCRIPTION

Figure 1:
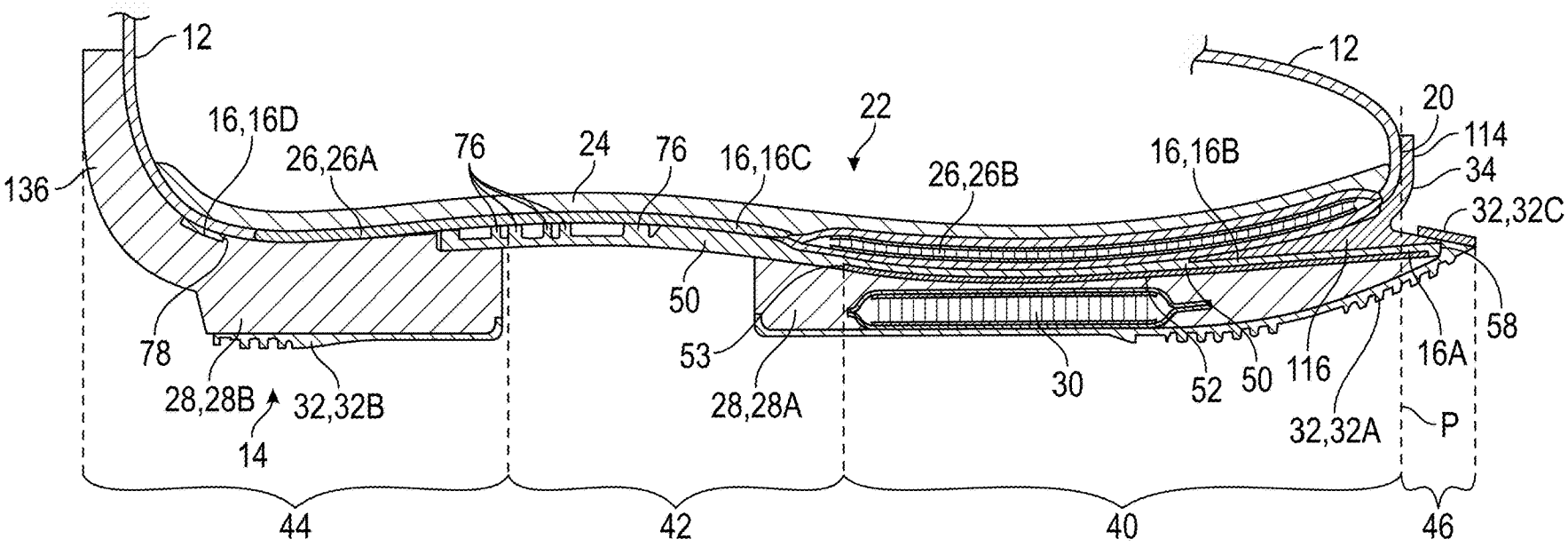
FIG. 1 is a cross-sectional and partially fragmentary view of an article of footwear including a sole structure with a plate, and is taken at lines 1-1 in FIG. 6.

The present disclosure generally relates to an article of footwear with a sole structure that includes a plate configured to function as a moment arm, such as at toe-off when jumping, while also enabling sufficient cushioning and maneuverability of the sole structure.

In an example, an article of footwear includes an upper and a sole structure. The sole structure includes a plate that has a heel portion, a midfoot portion, a forefoot portion, and an extension portion. The extension portion extends forward of the forefoot portion and forward of a foremost extent of the upper.

In some implementations, the plate may be a full-length plate that is only one layer (e.g., a single layer plate) and that has a varying stiffness along the length of the plate, such as a greater bending stiffness in the forefoot portion and extension portion than in the midfoot portion and the heel portion.

In other implementations, the plate may include a first plate layer and a second plate layer. These may alternatively be referred to as a first plate and a second plate, respectively. The first plate layer may extend in each of the heel portion, the midfoot portion, the forefoot portion, and the extension portion. The second plate layer may interface with the first plate layer and extend in the forefoot portion and the extension portion. A bending stiffness of the second plate layer may be greater than a bending stiffness of the first plate layer. By positioning both plate layers in the forefoot portion and the extension portion, the stiffness of the sole structure in the forefoot region and the extension region is reinforced and the plate functions as a moment arm for toe-off and is sufficiently stiff to convert forward momentum into vertical height.

In some embodiments, the second plate layer may have a rearmost extent forward of the heel portion. For example, the second plate layer may extend in the forefoot portion and the extension portion but not in the heel portion. In some embodiments, the rearmost extent of the second plate layer may extend partially in the midfoot portion. In other embodiments, the rearmost extent may be forward of the midfoot portion, so that the second plate layer extends only in the forefoot portion and the extension portion.

In an implementation, the first plate layer may define a recess and the second plate layer may be nested in the recess of the first plate layer. Stated differently, the first plate layer and the second plate layer may interfit with one another.

An outer surface of the second plate layer may be flush with an outer surface of the first plate layer both forward of the recess and rearward of the recess. This enables the desired targeted stiffness enhancement of the sole structure in the region where the recess is located without increasing the overall stack height of the plate where the first and second plate layers are adjacent to one another.

For example, the recess may be in a foot-facing surface of the first plate layer so that the second plate layer is disposed above the first plate layer at the recess. In another example, the recess may be in a ground-facing surface of the first plate layer so that the second plate layer is disposed below the first plate layer at the recess.

Although the first and second plate layers may be the same material, in one or more embodiments, the first plate layer may be a first material, and the second plate layer may be a second material different than the first material.

In an example, the first material may comprise thermoplastic polyurethane and the second material may comprise a carbon fiber composite. The carbon fiber composite may include a base material and carbon fibers disposed within the base material.

In an implementation, an elastic modulus of the base material may be from about 2 gigapascals (GPa) to about 130 GPa under flex loading along a longitudinal midline of the second plate layer.

In a more specific example, the elastic modulus of the base material may be from about 104 GPa to about 108 GPa under axial loading and about 120 GPa under flex loading along the longitudinal midline when the base material has a thickness of about 1.125 millimeters.

A bending stiffness of the plate, including both the first plate layer and the second plate layer) may be approximately 700 Newtons per millimeter in the forefoot region and the extension region, and may be approximately 650 Newtons per millimeter in the midfoot region.

In an aspect, the plate may transition along a longitudinal midline of the plate from relatively curved to relatively flat in the forefoot portion and may remain relatively flat in the extension portion. Stated differently, a curvature of the plate along the longitudinal midline of the plate may be greater in the forefoot portion than in the extension portion. By providing a relatively curved forefoot portion, dorsiflexion and forward roll are not inhibited. By providing a relatively flat extension portion, the sole structure at the forward end of the extension portion engages the ground surface earlier in a forward rotation about the forward end of the extension portion than if the extension portion were more curved, thus enabling a quicker toe-off.

A toe spring angle of the extension portion may be less than or equal to 12 degrees, and may be from 5 degrees to 12 degrees relative to a horizontal ground plane. With such a relatively small toe spring angle, toe-off may occur earlier in a forward roll. Additionally, a ground-contact surface of the sole structure underlying the extension portion of the plate may have a toe spring angle larger than the toe spring angle of the extension portion of the plate. The larger toe spring angle of the sole structure at the ground-contact surface promotes a quick initial forward roll to the point where the sole structure at the forward end of the extension portion that has the lesser toe spring angle then engages the ground. Because the sole structure at the extension portion remains relatively stiff due to the plate, a greater moment arm for launching into a jump is provided relative to a sole structure that does not have a plate with the extension portion.

In some embodiments, a ratio of a length of the extension portion along a longitudinal midline of the plate to a length of the plate along the longitudinal midline of the plate may be from 0.25 to 0.35. A ratio within this range may provide the desired moment arm, especially when combined with the desired toe spring angles and bending stiffnesses discussed herein. In a specific embodiment, the ratio of the length of the extension portion along a longitudinal midline of the plate to the length of the plate along the longitudinal midline of the plate may be 0.29.

To provide greater flexibility, a midsole underlying the plate may be separated into discreet components, including a front midsole layer and a rear midsole layer. The forefoot midsole layer may be secured to a ground-facing surface of the plate at the forefoot portion of the plate. The heel midsole layer may be secured to the ground-facing surface of the plate at the heel portion of the plate and may be spaced apart from the forefoot midsole layer so that the ground-facing surface of the plate at the midfoot portion of the plate is exposed between the forefoot midsole layer and the heel midsole layer.

To limit twisting of the plate at the midfoot portion, a foot-facing surface of the plate in the midfoot portion may include upwardly-extending and transversely-elongated protrusions for torsional rigidity. For example, the protrusions may extend substantially from the medial side to the lateral side of the sole structure, serving as reinforcing struts.

In order to provide desirable cushioning for heel strikes, the plate may define a through hole extending through the plate from a foot-facing surface of the plate to a ground-facing surface of the plate at the heel portion of the plate. A midsole layer, such as the heel midsole layer discussed above, may underlie the plate at the through hole.

To provide responsiveness and cushioning in the forefoot region even with the presence of the relatively stiff plate, the sole structure may further include additional components in the forefoot region. For example, a bladder defining a sealed, fluid-filled chamber may underlie the forefoot portion of the plate. With the plate disposed over the bladder, the plate may act to distribute compressive forces evenly over the bladder.

A midsole layer may underlie the plate and be disposed between the plate and the bladder. In this arrangement, the bladder may be disposed closer to the ground than the plate, and, in one or more embodiments, with only an outsole between the ground and the bladder.

The bladder may include a first polymeric sheet and a second polymeric sheet bonded to the first polymeric sheet at a peripheral flange that seals the fluid-filled chamber. The bladder may define a simple fluid-filled chamber without additional elements within the fluid-filled chamber. Alternatively, a tensile component may be disposed in the fluid-filled chamber and may include a first tensile layer, a second tensile layer, and a plurality of tethers spanning the fluid-filled chamber from the first tensile layer to the second tensile layer and connecting the first tensile layer to the second tensile layer. The tethers slacken when the fluid-filled bladder is elastically deformed under compression, and return to a tensioned state when the fluid-filled bladder returns the energy applied to elastically deform the bladder as the compression is relieved.

For additional cushioning and responsiveness, the article of footwear may include a strobel that has a bladder that defines a sealed, fluid-filled chamber in a forefoot region of the article of footwear. For example, the strobel with the bladder may overlie the plate, such as over the forefoot portion of the plate. A lasting component may be secured to the upper and to the bladder and may extend in a midfoot region and in a heel region of the article of footwear. For example, the lasting component may be a relatively inelastic material. Accordingly, by providing a bladder as a forefoot portion of the strobel, a soft underfoot feel may be achieved even with the presence of the relatively stiff plate.

In an implementation, the sole structure may include a toe support that extends over a foot-facing surface of the extension portion of the plate. The toe support may have a wall extending upward along the foremost extent of the upper. The toe support may be a stiffer material than the upper, such as a thermoplastic polyurethane similar to the material of the first plate layer of an embodiment described herein. Accordingly, the toe support may help to distribute and direct longitudinal bending forces over the plate.

Furthermore, the wall of the toe support may extend along a medial side of the upper in the forefoot region of the article of footwear as well as along the lateral side of the upper in the forefoot region of the article of footwear. In some embodiments, the toe support may extend further rearward along the lateral side of the upper than along the medial side of the upper, thus helping to distribute lateral forces over the plate.

Within the scope of the disclosure, an article of footwear may include an upper and a sole structure. The sole structure may include a plate having a heel portion, a midfoot portion, a forefoot portion, and an extension portion. For example, the plate may be a single layer of a single material or a composite material along the length of the plate, and may have a varying thickness along the length of the plate. Alternatively, the plate may have multiple layers that may be of the same or different materials. The extension portion may extend forward of the forefoot portion and forward of a foremost extent of the upper. The sole structure may also include at least one sole layer underlying the extension portion of the plate and establishing a ground-contact surface of the sole structure. A toe spring angle of the sole structure at the ground-contact surface underlying the extension portion of the plate may be greater than a toe spring angle of the extension portion of the plate. With this configuration, a quick forward roll and engagement of the sole structure at the extension portion with the ground for toe-off may be achieved, with the plate having sufficient stiffness under longitudinal bending forces to convert the forward motion into vertical motion.

In one or more embodiments, the toe spring angle of the extension portion may be less than or equal to 12 degrees relative to a horizontal ground plane. In a specific example, the toe spring angle of the extension portion may be from 5 degrees to 12 degrees.

The above features and advantages and other features and advantages of the present teachings are readily apparent from the following detailed description of the modes for carrying out the present teachings when taken in connection with the accompanying drawings. It should be understood that even though in the following Figures embodiments may be separately described, single features thereof may be combined to additional embodiments.

Referring to the drawings, wherein like reference numbers refer to like components, FIG. 1 is a cross-sectional and partially fragmentary view of an article of footwear 10. The article of footwear 10 includes an upper 12 secured to a sole structure 14. As discussed herein, the sole structure 14 includes a plate 16 that has an extension portion 16A extending forward of a foremost extent 20 of the upper 12. The plate 16 may be referred to as an extended plate 16. The sole structure 14 is configured to enable a relatively quick toe-off. The moment arm of the extension portion 16A in combination of the relative stiffness of the plate 16 as discussed herein may better convert forward momentum into vertical jump height than would a sole structure without the plate 16. Additionally, the article of footwear 10 has features to ensure comfort and maneuverability even with the extended, relatively stiff plate 16.

Before discussing each in greater detail below, the components of the article of footwear 10 are briefly described with respect to FIG. 1. The upper 12 defines a foot-receiving cavity 22 over the sole structure 14. The upper 12 may be a variety of materials, such as leather, textiles, polymers, cotton, foam, composites, etc. An insole 24 is disposed within the foot-receiving cavity 22 and provides a foot-contact surface for the wearer's foot to rest on. A strobel 26 is secured to the upper 12 such as by stitching, adhesive, or otherwise, and is disposed under the insole 24, defining a bottom of the foot-receiving cavity 22. The strobel 26 includes a portion 26A generally in the midfoot region 42 and the heel region 44 of the article of footwear 10. The portion 26A may be a relatively inextensible textile material that is stitched to the upper 12. The strobel 26 also includes a forefoot bladder 26B as discussed herein. In some embodiments, the insole 24 need not be present, and the strobel 26 may be the foot-contact surface. Additionally, a traditional strobel without a forefoot bladder 26B may instead be used. For example, the material of portion 26A may continue throughout the forefoot region 40 instead of a forefoot bladder 26B.

In addition to the plate 16, the sole structure 14 includes a midsole 28 that includes a forefoot midsole layer 28A and a heel midsole layer 28B. The sole structure 14 also includes a forefoot bladder 30 that underlies the plate 16 with the forefoot midsole layer 28A disposed between the plate 16 and the forefoot bladder 30 in the embodiment shown. The sole structure 14 further includes an outsole 32 having a front outsole element 32A secured to the forefoot midsole layer 28A and a heel outsole element 32B secured to the heel midsole layer 28B. Additionally, the sole structure 14 includes a toe support 34 and a toe outsole element 32C secured to the toe support 34.

The midsole 28 may be formed from a compressible polymer foam element (e.g., a polyurethane or ethylvinylacetate foam) that attenuates ground reaction forces (e.g., provides cushioning) when compressed between a foot and the ground during walking, running, or other ambulatory activities. The midsole layers 28A, 28B may be foam bodies such as a foamed polymeric material. In some embodiments, the midsole 28 may be at least partially a polyurethane (PU) foam, a polyurethane ethylene-vinyl acetate (EVA) foam, and may include heat-expanded and molded EVA foam pellets. In some examples, the foam material may comprise a blend of EVA material or materials, for example. The midsole 28 may comprise Pebax® thermoplastic elastomer foam and may be sold under the tradename ZoomX by Nike, Inc. In one or more embodiments, the midsole layers 28A, 28B may be of a material of sufficient durability to serve as the ground-contact surface of the article of footwear 10 so that no separate outsole elements 32A, 32B are included, or outsole elements may be included only at targeted portions of the ground-contact surface, such as at high wear areas.

The outsole elements 32A and 32B may include a rubber material that may be a natural rubber, a synthetic rubber, or a combination of both. Examples of types of rubbers that may be used include butadiene rubber, styrene-butadiene (SBR) rubber, butyl rubber, isoprene rubber, urethane rubber, nitrile rubber, neoprene rubber, ethylene propylene diene monomer (EPDM) rubber, ethylene-propylene rubber, polynorbornene rubber, methyl methacrylate butadiene styrene (MBS) rubber, styrene ethylene butylene (SEBS) rubber, silicone rubber, and mixtures thereof. The rubber compound may be a virgin material, a regrind material, and mixtures thereof.

Figure 6:
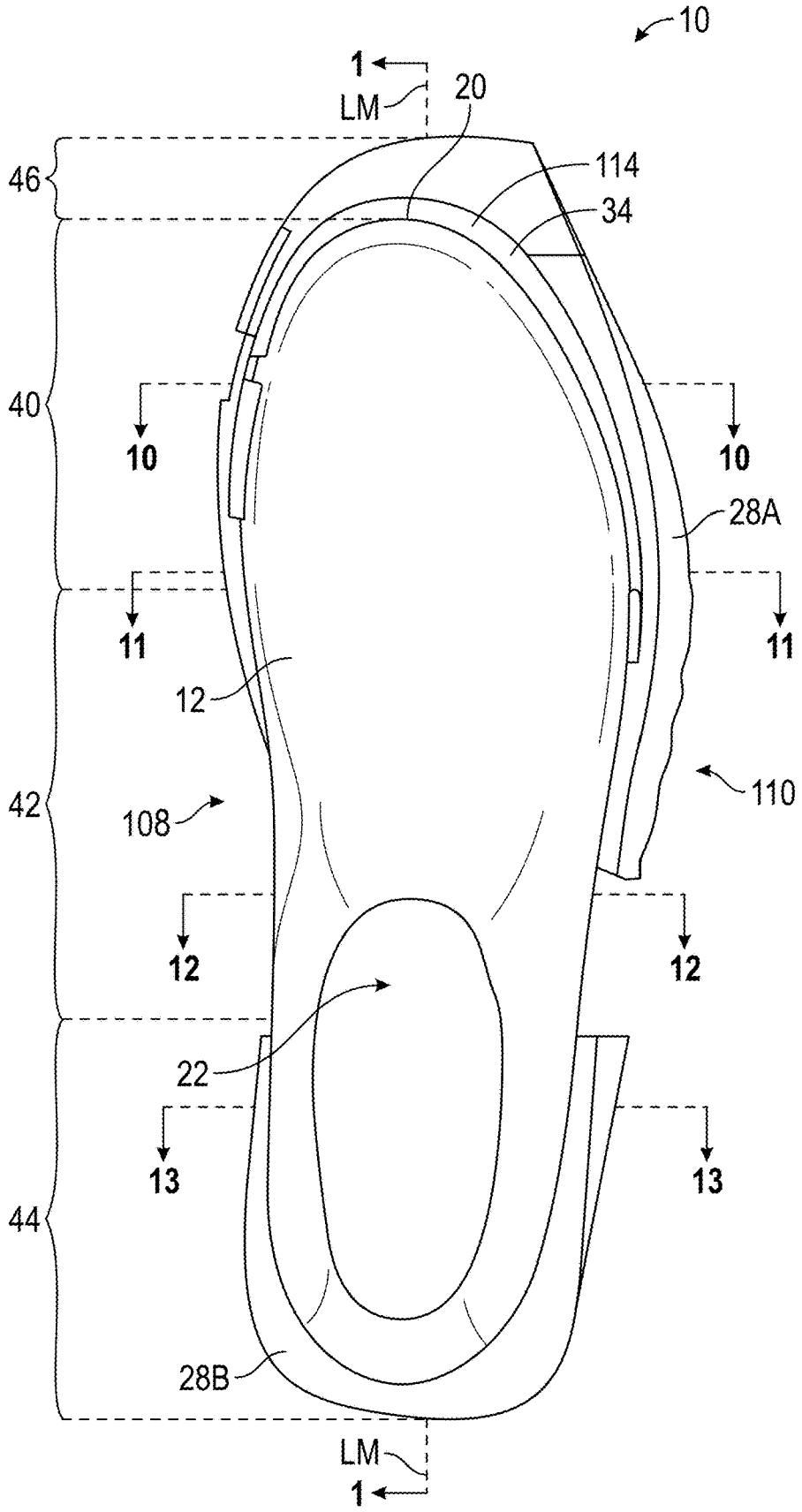
FIG. 6 is a top view of the article of footwear of FIG. 1.

As shown in FIGS. 1 and 6, the article of footwear 10 includes a forefoot region 40, a midfoot region 42, and a heel region 44. Due to the extension portion 16A of the plate 16, the article of footwear 10 also includes an extension region 46 forward of the forefoot region 40. The forefoot region 40 generally includes portions of the article of footwear 10 corresponding with the toes and the metatarsophalangeal joints (which may be referred to as MPT or MPJ joints) connecting the metatarsal bones of the foot and the proximal phalanges of the toes. The midfoot region 42 generally includes portions of the article of footwear 10 corresponding with the arch area and instep of the foot, and the heel region 44 corresponds with rear portions of the foot, including the calcaneus bone. The forefoot region 40, the midfoot region 42, and the heel region 44 are not intended to demarcate precise areas of the article of footwear 10, but are instead intended to represent general areas to aid in the following discussion.

Figure 20:
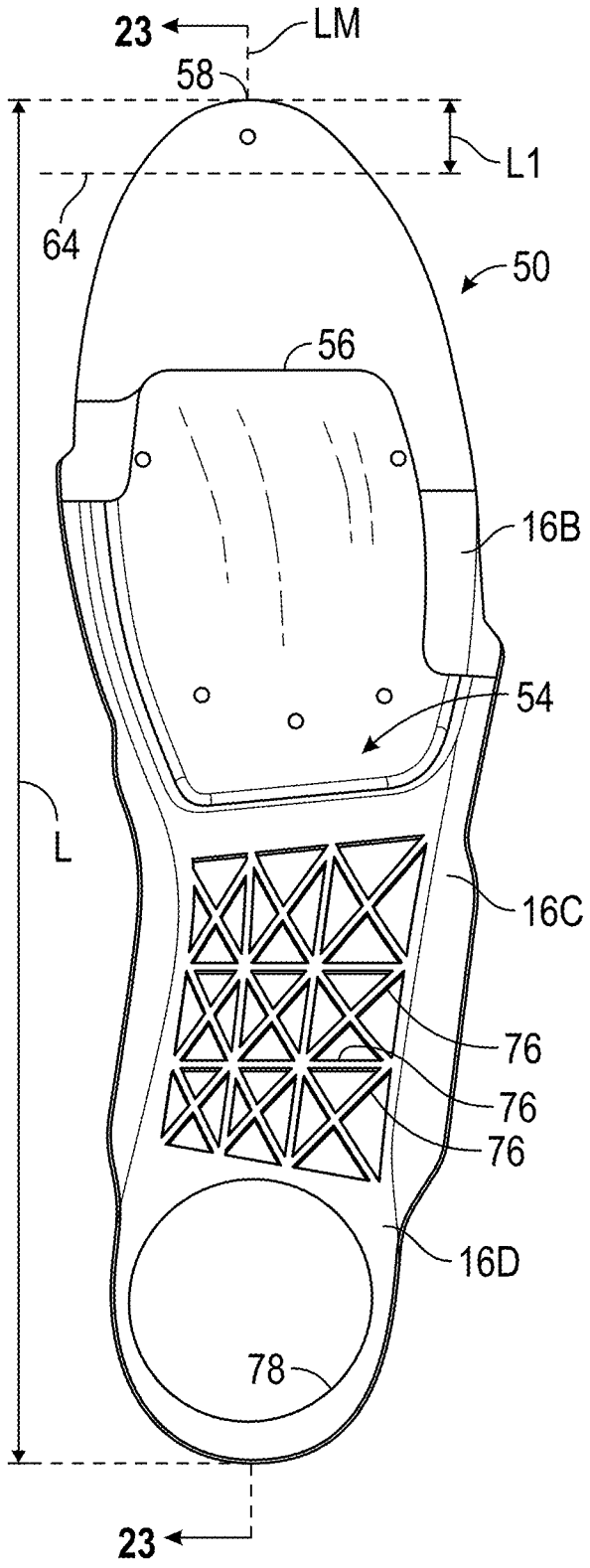
FIG. 20 is a top view of a first plate layer included in the sole structure of the article of footwear of FIG. 1.

The plate 16 may be referred to as a full-length plate as it extends in each of the heel region 44, the midfoot region 42, the forefoot region 40, and the extension region 46. As such, the plate 16 is configured to extend below the length of a foot supported by the sole structure 14. As shown in FIGS. 1 and 20, the plate 16 has a heel portion 16D that is disposed in the heel region 44 in FIG. 1, a midfoot portion 16C disposed in the midfoot region 42, a forefoot portion 16B disposed in the forefoot region 40, and an extension portion 16A disposed in the extension region 46. The extension portion 16A extends forward of the forefoot portion 16B and forward of the foremost extent 20 of the upper 12. More specifically, a conventional plate for the sole structure 14 would have a forward distal end no further forward than a forward edge of the forefoot portion 16B which is at a line 64 (see FIG. 20) that corresponds with the position of a plane P (shown in FIG. 1) that is tangent to the foremost extent 20 of the upper 12 above the plate 16 and perpendicular to a longitudinal midline LM of the sole structure 14.

Figure 3:
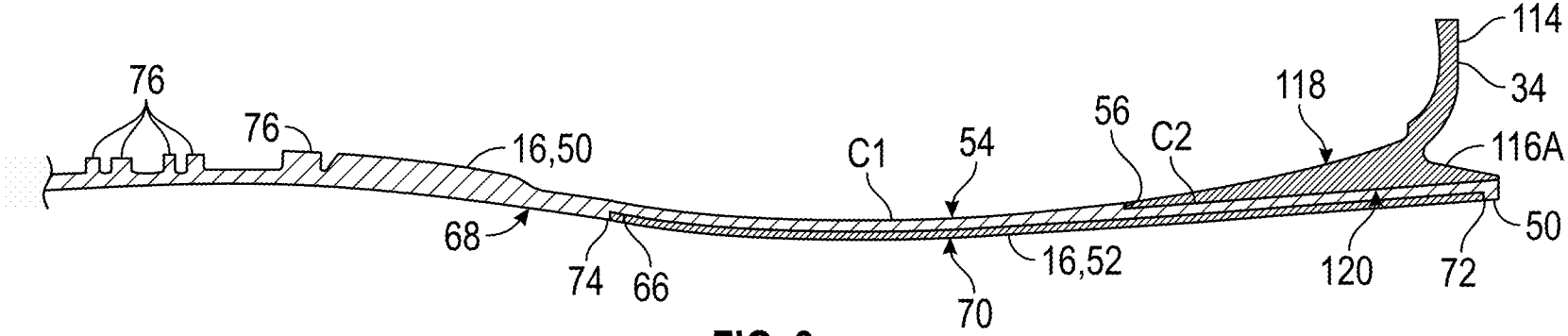
FIG. 3 is a fragmentary cross-sectional view of the plate having first and second plate layers, and a toe support of the sole structure of the article of footwear of FIG. 1.

FIG. 3 is a fragmentary cross-sectional view of the plate 16 having a first plate layer 50, a second plate layer 52, and a toe support 34 of the sole structure 14 of the article of footwear 10 of FIG. 1. As best shown in FIG. 3, the plate 16 includes a first plate layer 50 and a second plate layer 52. These may alternatively be referred to as a first plate and a second plate, respectively, in which case the plate 16 may be referred to as a plate assembly. The first plate layer 50 extends in and at least partially establishes each of the heel portion 16D, the midfoot portion 16C, the forefoot portion 16B, and the extension portion 16A, as shown in FIG. 20. The second plate layer 52 extends in the forefoot portion 16B and the extension portion 16A, and has a rearmost extent 53 forward of the heel portion 16D. Stated differently, the second plate layer 52 does not extend in at least all of the midfoot portion 16C (but may extend in a forward part of the midfoot portion in some embodiments) and does not extend in the heel portion 16D. In some embodiments, such as that shown in FIG. 1, the second plate layer 52 extends only in the extension portion 16A and the forefoot portion 16B. Accordingly, the second plate layer 52 extends in the extension region 46 and the forefoot region 40, and not in the heel region 44. As shown, the second plate layer 52 also does not extend on the midfoot region 42, but could extend at least in a forward part of the midfoot region 42 within the scope of the disclosure.

A bending stiffness of the second plate layer 52 is greater than a bending stiffness of the first plate layer 50 in the embodiment shown, which is due to the different materials of the first and second plate layers 50, 52 as discussed further with respect to FIGS. 20-26. By positioning both plate layers 50, 52 in both of the forefoot portion 16B and the extension portion 16A, the stiffness of the sole structure 14 in the forefoot region 40 and the extension region 46 is reinforced so that the plate 16 functions as a moment arm at toe-off and is sufficiently stiff to help convert forward momentum of the wearer into vertical height from the ground plane G when jumping. In an example, a bending stiffness of the plate 16, including both the first plate layer 50 and the second plate layer 52 may be approximately 700 Newtons per millimeter in the forefoot region 40 and the extension region 46, and may be approximately 650 Newtons per millimeter in the midfoot region 42.

Figure 2:
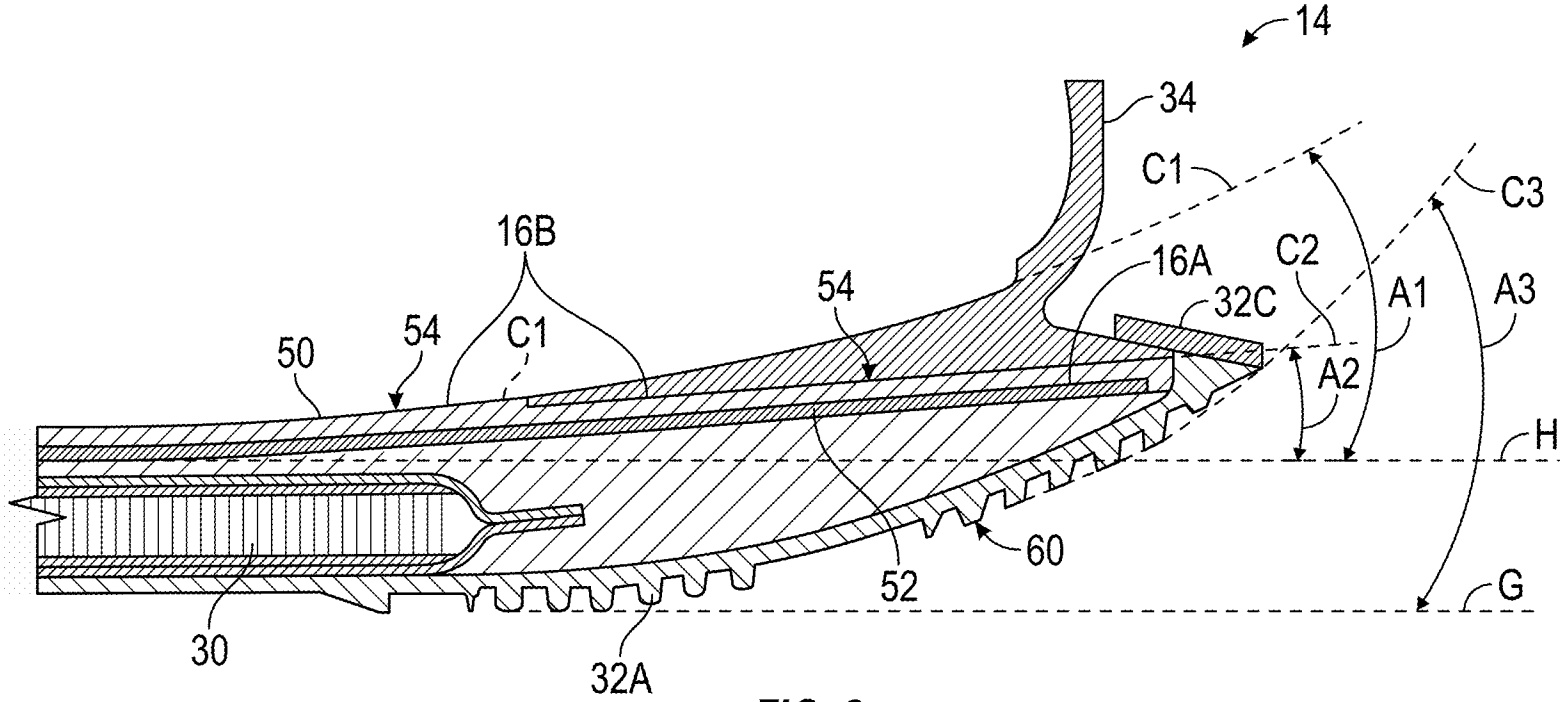
FIG. 2 is a close up fragmentary view of a portion of the sole structure of FIG. 1.

With reference to FIGS. 2-3 and 20, the plate 16 transitions along the longitudinal midline LM (indicated in FIG. 20) from relatively curved to relatively flat in the forefoot portion 16B and remains relatively flat in the extension portion 16A. FIG. 2 shows a curvature C1 of the plate 16 in the forefoot portion 16B, and more specifically, the curvature C1 of the first plate layer 50. The curvature C1 is taken tangent to a foot-facing surface 54 of the plate 16. A curvature C2 taken tangent to the foot-facing surface 54 at the extension portion 16A remains relatively flat in comparison to curvature C1. As best shown in FIGS. 3 and 20, the plate 16 is molded to form or is otherwise provided with a transition line 56 at which the curvature changes from the relatively curved curvature C1 to the relatively flat curvature C2 so that the curvature of the plate 16 along the longitudinal midline LM is greater in the forefoot portion 16B (or at least in a rear part of the forefoot portion) than in the extension portion 16A. The relatively curved forefoot portion 16B helps to ensure that dorsiflexion and a forward roll are not overly restricted. A forward part of the forefoot portion 16B also follows the relatively flat curvature C2, as the transition line 56 is in the forefoot portion 16B, rearward of the plane P. By providing a relatively flat extension portion 16A, the sole structure 14 at the forward end 58 of the extension portion 16A engages a horizontal ground plane G earlier in a forward rotation about the forward end 58 of the extension portion 16A than if the extension portion were more curved (e.g. had the curvature C1), enabling a quicker toe-off. This is because if the extension portion 16A were more curved, the forward end 58 would be located higher, and therefore further from the horizontal ground plane G at any given point relative to a relatively flat extension portion 16A. By configuring the plate 16 with a specific curvature C2, a specific ratio of length L1 of the extension portion 16A to length L of the plate 16 along the longitudinal midline LM, and a specific bending stiffness, conversion of forward momentum to vertical height as well as quick toe-off can be optimized.

FIG. 2 shows that, with the relatively flat curvature C2, a toe spring angle A2 of the extension portion 16A may be from 5 degrees to 12 degrees relative to a horizontal ground plane G (or additional horizontal plane H shown in FIG. 2). This is much less than a toe spring angle A1 that would result if the curvature C1 of the forefoot portion 16B continued in the extension portion 16A. With such a relatively small toe spring angle, toe-off may occur earlier in a forward roll. Additionally, FIG. 2 shows that a ground-contact surface 60 of the front outsole element 32A of the sole structure 14 underlying the extension portion 16A of the plate 16 has a curvature C3 that creates a toe spring angle A3 greater than the toe spring angle A2 of the extension portion 16A. The larger toe spring angle A3 of the sole structure 14 at the ground-contact surface 60 promotes a quick initial forward roll to a point (e.g., an angle of lift of the heel) where the sole structure 14 at the forward end 58 of the extension portion 16A then engages the horizontal ground plane G. The extension region 46 remains relatively stiff due to the extension portion 16A of the plate 16. This enables a greater moment arm for launching into a jump relative to a sole structure without the plate having the extension portion, as such a sole structure without a plate having the extension portion would more likely compress and collapse at the forward end during toe-off.

With reference to FIG. 20, in some embodiments such as that shown, the extension portion 16A has a length L1, and the plate 16 has a length L along the longitudinal midline LM of the plate 16 from the forward end 58 of the extension portion 16A to the rear of the plate 16 (e.g., the rearmost point in the heel region 44 of FIG. 1). A ratio of the length L1 to the length L of the plate 16 along the longitudinal midline LM may be from 0.25 to 0.35. In the specific embodiment shown, the ratio of the length L1 to the length L of the plate 16 along the longitudinal midline LM is 0.29. The length of the extension portion 16A is measured from line 64 to the forward end 58. The line 64 corresponds with the position of a plane P (shown in FIG. 1) perpendicular to the longitudinal midline LM and tangent to a foremost extent 20 of the upper 12 above the plate 16. By maintaining a relatively low ratio of from 0.25 to 0.35, the extension portion 16A is short enough for a quick forward roll and take off. Providing a relatively flat extension portion 16A with at least some positive toe spring (e.g., not completely parallel to the ground plane G, but with a slight upward curvature) may also minimize unintentional ground engagement that could occur at relatively small toe spring angles.

Figure 21:
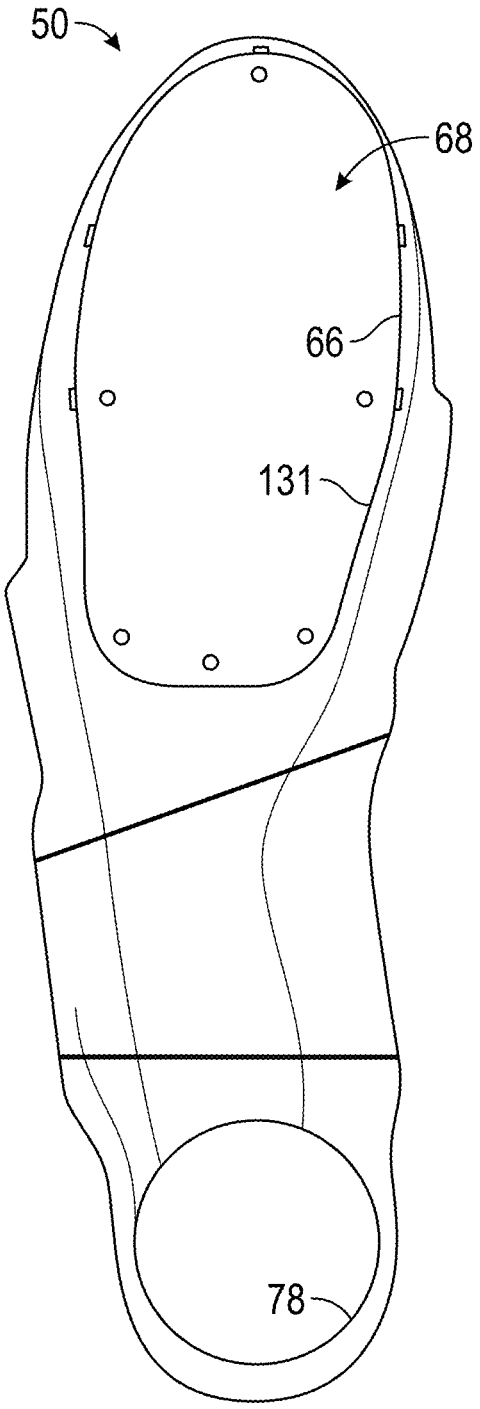
FIG. 21 is a bottom view of the first plate layer of FIG. 20.

As shown in FIGS. 3 and 21, the first plate layer 50 defines a recess 66 in a ground-facing surface 68 of the first plate layer 50. FIGS. 1 and 3 show that the second plate layer 52 is nested in the recess 66. The second plate layer 52 interfaces with the first plate layer 50 in the recess 66 in that a top surface (e.g., a foot-facing surface) of the second plate layer 52 is disposed against a bottom surface (e.g., a ground-facing surface) of the first plate layer 50. The recess 66 has a depth that corresponds with a thickness of the second plate layer 52 so that the outer surface (e.g., the ground-facing surface 70) of the second plate layer 52 is flush with the ground-facing surface 68 of the first plate layer 50 both forward of the recess 66 (see location 72 in FIG. 3) and rearward of the recess 66 (see location 74 in FIG. 3). This enables the desired targeted stiffness enhancement of the sole structure 14 in the forefoot region 40 and the extension region 46 where the recess 66 is located without increasing the overall stack height of the plate 16 where the first and second plate layers 50, 52 are adjacent to one another.

The forefoot midsole layer 28A extends completely under the entire length and width of the portion of the plate 16 that includes the recess 66 and the second plate layer 52. The forefoot midsole layer 28A is spaced apart from the heel midsole layer so that the outer surface of the first plate layer 50 that is the ground-facing surface 68 of the plate 16 at the midfoot portion 16C of the plate 16 is exposed between the forefoot midsole layer 28A and the heel midsole layer 28B. The plate 16 includes only the first plate layer 50 at this exposed midfoot portion 16C.

Figure 12:
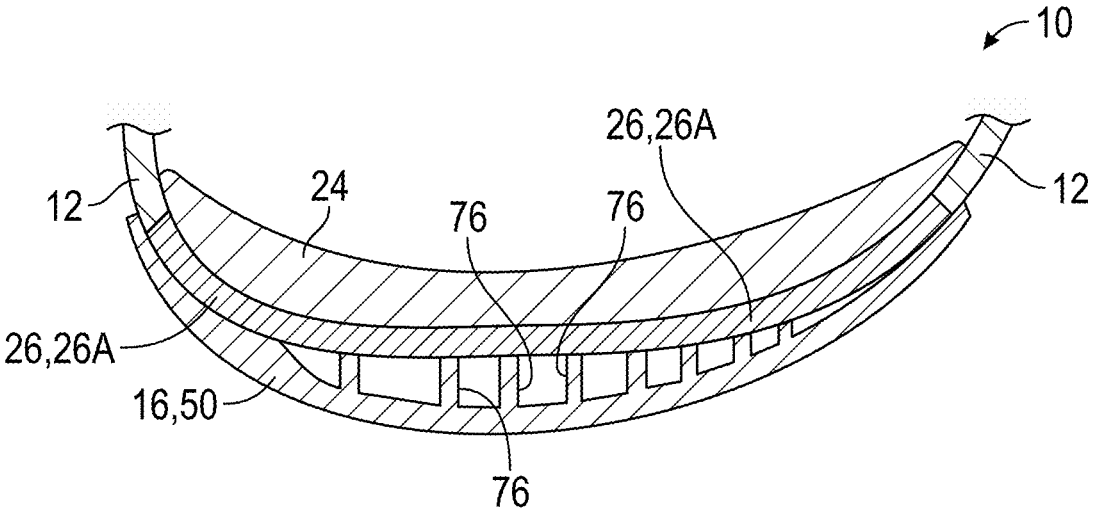
FIG. 12 is a cross-sectional and partially fragmentary view of the article of footwear of FIG. 1 taken at lines 12-12 in FIG. 6.

To increase the torsional rigidity of this exposed midfoot portion 16C, the foot-facing surface 54 of the plate 16 opposite from the exposed portion of the ground-facing surface 68 includes upwardly-extending protrusions 76 (only some of which are labeled with reference numbers). FIG. 12 is a cross-section at the exposed portion, showing the upwardly-extending protrusions 76. As best shown in FIG. 20, the protrusions 76 are transversely elongated, and extend in an intersecting pattern across the longitudinal midline LM substantially from a medial side to a lateral side of the foot-facing surface 54. The protrusions 76 are thus configured as struts to limit twisting of the plate 16 at the midfoot portion 16C increasing the torsional rigidity of the sole structure 14 in the midfoot portion 16C. In the embodiment shown, the exposed ground-facing surface 68 of the plate 16 at the midfoot portion 16C is smooth (e.g., does not have protrusions 76), but in other embodiments protrusions to increase torsional rigidity could also be provided at the ground-facing surface 68.

In order to provide a softer feel to the sole structure 14, the plate 16 defines a through hole 78 in the heel portion 16D, as best shown in FIGS. 1 and 20-21. The through hole 78 extends through the plate 16 from the foot-facing surface 54 of the plate 16 to the ground-facing surface 68 of the plate at the heel portion 16D of the plate 16. Because only the first plate layer 50 extends in the heel portion 16D, the through hole 78 is in the first plate layer 50. The heel midsole layer 28B underlies the plate 16 at the through hole 78. As is apparent in FIGS. 1 and 13, the heel midsole layer 28B extends upward into and fills the through hole 78. The portion 26A of the strobel 26 is secured to the heel midsole layer 28B at the through hole 78. The heel midsole layer 28B may be a foam material and is more resiliently compressible than the plate 16. Accordingly, the wearer will experience greater cushioning at the heel where the heel rests over the through hole 78 than if the plate 16 extended in the heel portion 16D without the through hole 78.

As shown in FIG. 1, both the forefoot bladder 26B of the strobel 26 and the forefoot bladder 30 of the sole structure 14 are polymeric bladders that enclose a fluid-filled chamber. More specifically, referring to FIG. 10, the forefoot bladder 26B of the strobel 26 includes a first polymeric sheet 80 and a second polymeric sheet 82 bonded to the first polymeric sheet at a peripheral flange 84 that seals a fluid-filled chamber 86. A tensile component 88 is disposed in the chamber 86 and connects an inner surface of the first polymeric sheet 80 to an inner surface of the second polymeric sheet 82. The tensile component 88 includes a first tensile layer 90 bonded to the inner surface of the first polymeric sheet 80, a second tensile layer 92 bonded to the inner surface of the second polymeric sheet 82, and a plurality of tethers 94 that span the fluid-filled chamber 86 from the first tensile layer 90 to the second tensile layer 92 and connect the first tensile layer 90 to the second tensile layer 92. The tethers 94 slacken when the fluid-filled forefoot bladder 26B is elastically deformed under dynamic compression, and return to a tensioned state (due to an inflation pressure of the fluid-filled bladder 26B) when the fluid-filled bladder 26B returns the energy applied to elastically deform the fluid-filled bladder 26B as the compression is relieved. By providing the forefoot bladder 26B close to the foot (e.g., in the foot-receiving cavity 22 under only the insole 24), the responsiveness and cushioning of the forefoot bladder 26B may be more readily perceived by the wearer. Only a small, forward portion of the flange of the forefoot bladder 30 is shown in the cross-section of FIG. 10.

Figure 11:
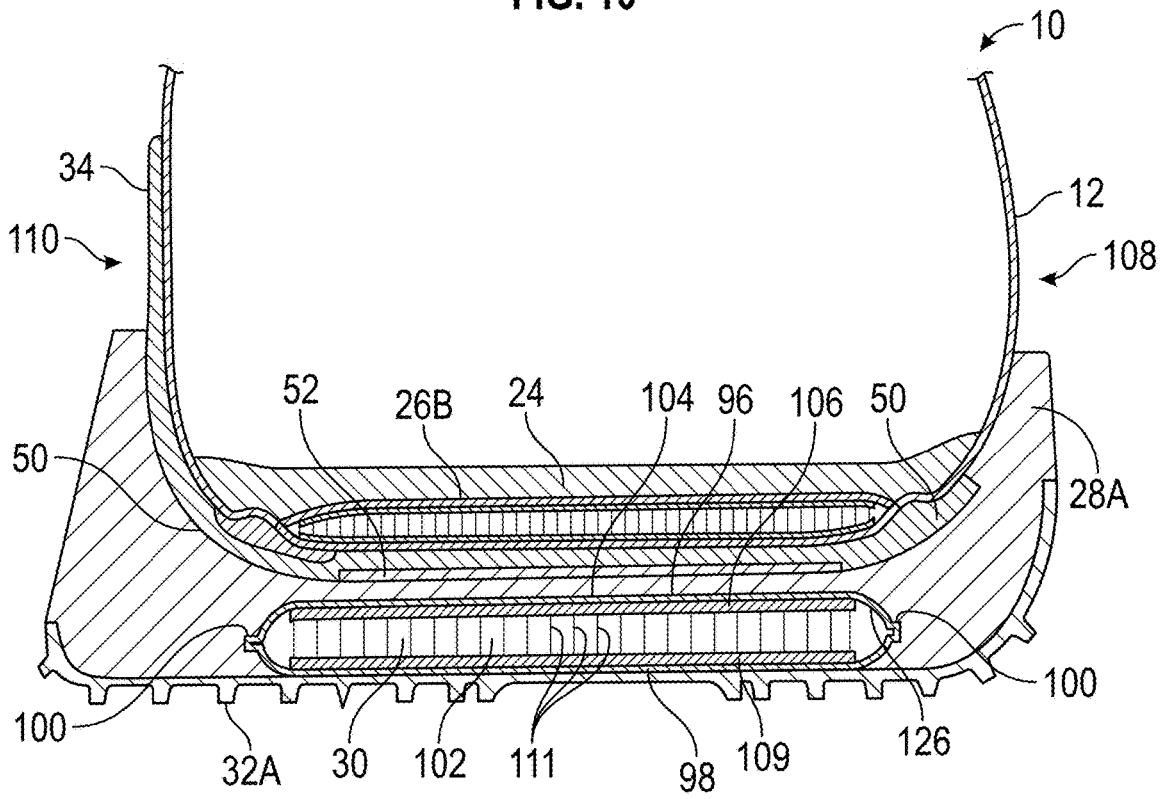
FIG. 11 is a cross-sectional and partially fragmentary view of the article of footwear of FIG. 1 taken at lines 11-11 in FIG. 6.

Similarly, and with reference to FIG. 11, the forefoot bladder 30 of the sole structure 14 includes a first polymeric sheet 96 and a second polymeric sheet 98 bonded to the first polymeric sheet 96 at a peripheral flange 100 that seals a fluid-filled chamber 102. A tensile component 104 is disposed in the chamber 102 and connects an inner surface of the first polymeric sheet 96 to an inner surface of the second polymeric sheet 98. The tensile component 104 includes a first tensile layer 106 bonded to the inner surface of the first polymeric sheet 96, a second tensile layer 109 bonded to the inner surface of the second polymeric sheet 98, and a plurality of tethers 111 that span the fluid-filled chamber 102 from the first tensile layer 106 to the second tensile layer 109 and connect the first tensile layer 106 to the second tensile layer 109. The tethers 111 slacken when the fluid-filled forefoot bladder 30 is elastically deformed under dynamic compression, and return to a tensioned state when the fluid-filled bladder 30 returns the energy applied to elastically deform the fluid-filled bladder 30 as the compression is relieved. By providing the forefoot bladder 30 close to the ground (e.g., under the plate 16 and forefoot midsole layer 28A and over only the front outsole element 32A), the compressive forces of the plate 16 as well as the reaction forces of the ground may be more evenly dispersed over the fluid-filled bladder 30. For example, a localized force that may occur due to the metatarsal heads of the foot is dispersed over the forefoot bladder 30 by the ground and by the plate 16, compressing the forefoot bladder 30 as a unit across its width, rather than compressing only a more localized portion of the forefoot bladder 30. This generally allows more of the tethers 111 to grow slack and return to their tensioned state in unison, rather than causing one or more localized groups of tethers 111 slackening and tensioning differently than surrounding tethers, as may occur when a fluid-filled bladder is compressed under loading by a foot without a plate above and the ground relatively close below the bladder.

When the polymeric sheets 80, 82 are secured together at the peripheral flange 84 and the forefoot bladder 26B is sealed, the first polymeric sheet 80 and the second polymeric sheet 82 retain a fluid in the chamber 86. Similarly, when the polymeric sheets 96, 98 are secured together at the peripheral flange 100 and the forefoot bladder 30 is sealed, the first polymeric sheet 96 and the second polymeric sheet 98 retain a fluid in the chamber 102. As used herein, a "fluid" filling the chamber 86 may be a gas, such as air, nitrogen, another gas, or a combination thereof.

The polymeric sheets 80, 82, 96, and 98 can be a variety of polymeric materials that can resiliently retain a fluid such as nitrogen, air, or another gas. Examples of polymeric materials for the polymeric sheets 80, 82, 96, and 98 include thermoplastic urethane, polyurethane, polyester, polyester polyurethane, and polyether polyurethane. Moreover, each of the polymeric sheets 80, 82, 96, and 98 can be formed of layers of different materials including polymeric materials. In one embodiment, each of the polymeric sheets 80, 82, 96, and 98 is formed from thin films having one or more thermoplastic polyurethane layers with one or more barrier layers of a copolymer of ethylene and vinyl alcohol (EVOH) that is impermeable to the pressurized fluid contained therein such as a flexible microlayer membrane that includes alternating layers of a gas barrier material and an elastomeric material, as disclosed in U.S. Pat. Nos. 6,082,025 and 6,127,026 to Bonk et al. which are incorporated by reference in their entireties. Alternatively, the layers may include ethylene-vinyl alcohol copolymer, thermoplastic polyurethane, and a regrind material of the ethylene-vinyl alcohol copolymer and thermoplastic polyurethane. Additional suitable materials for the polymeric sheets 80, 82, 96, and 98 are disclosed in U.S. Pat. Nos. 4,183,156 and 4,219,945 to Rudy, which are incorporated by reference in their entireties. Further suitable materials for the polymeric sheets 80, 82, 96, and 98 include thermoplastic films containing a crystalline material, as disclosed in U.S. Pat. Nos. 4,936,029 and 5,042,176 to Rudy, and polyurethane including a polyester polyol, as disclosed in U.S. Pat. Nos. 6,013,340, 6,203,868, and 6,321,465 to Bonk et al. which are incorporated by reference in their entireties. In selecting materials for the forefoot bladders 26B and 30, engineering properties such as tensile strength, stretch properties, fatigue characteristics, dynamic modulus, and loss tangent can be considered. For example, the thicknesses of the polymeric sheets 80, 82, 96, and 98 used to form the forefoot bladders 26B and 30 can be selected to provide these characteristics.

Figure 4:
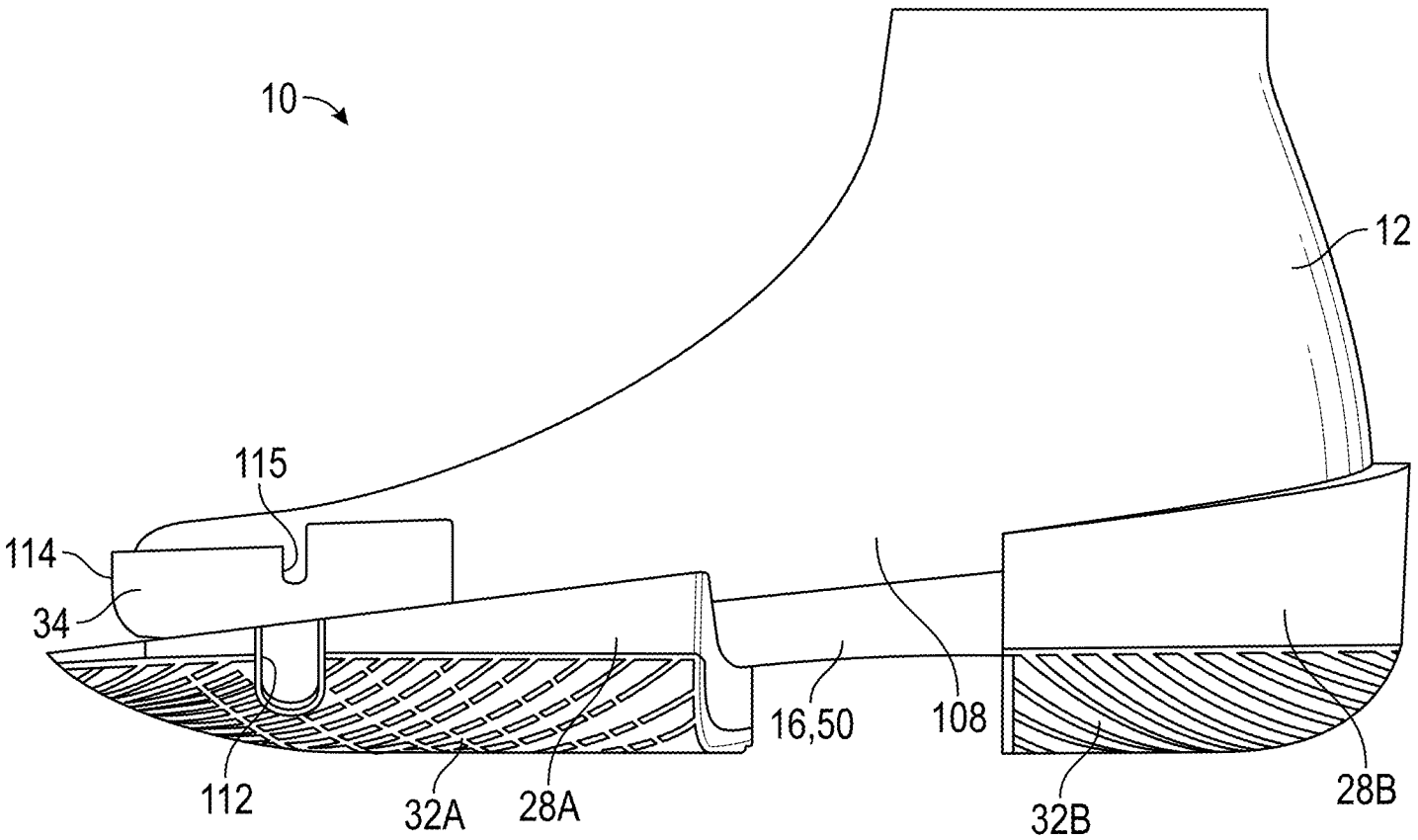
FIG. 4 is a medial side view of the article of footwear of FIG. 1.
Figure 5:
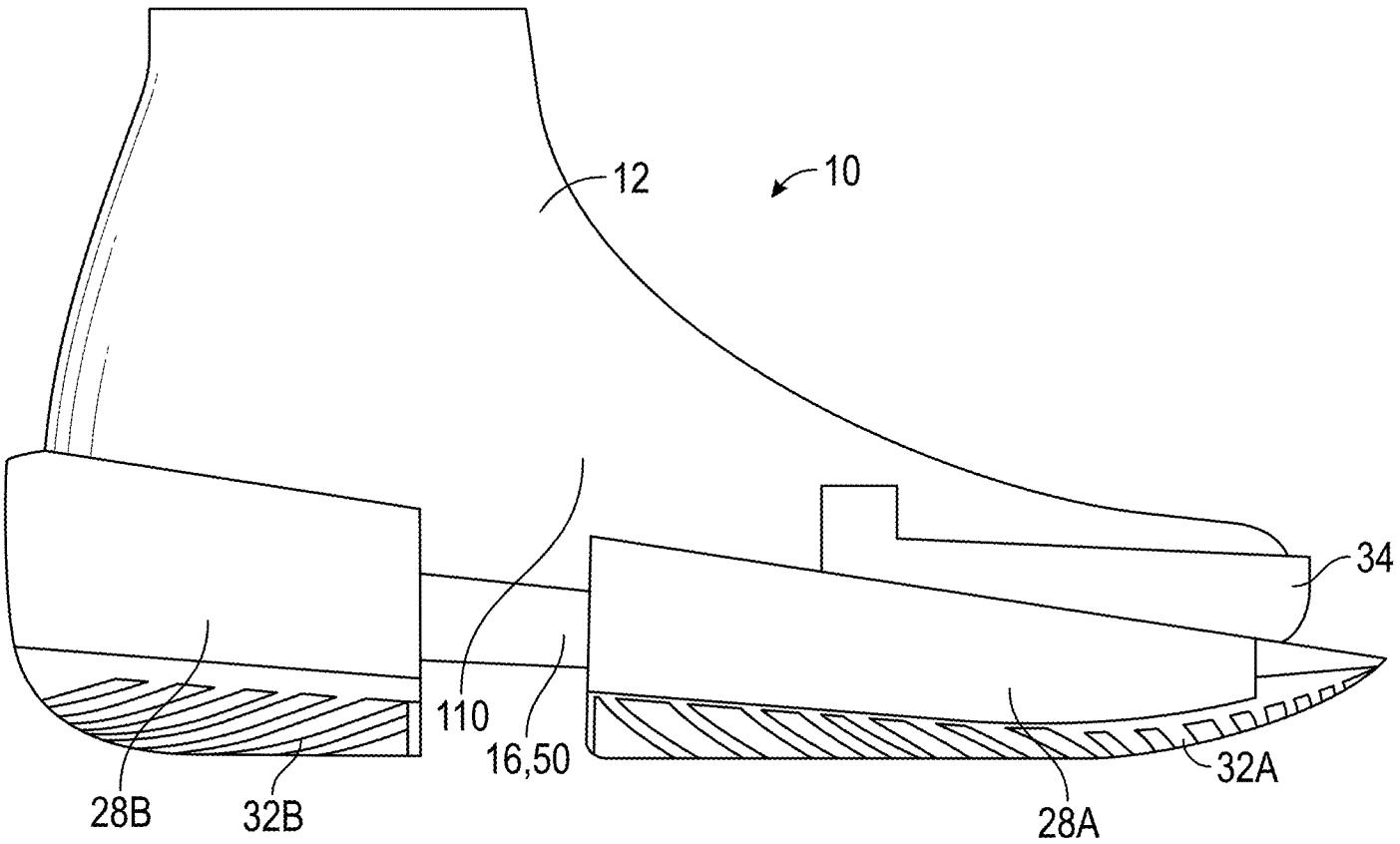
FIG. 5 is a lateral side view of the article of footwear of FIG. 1.
Figure 27:
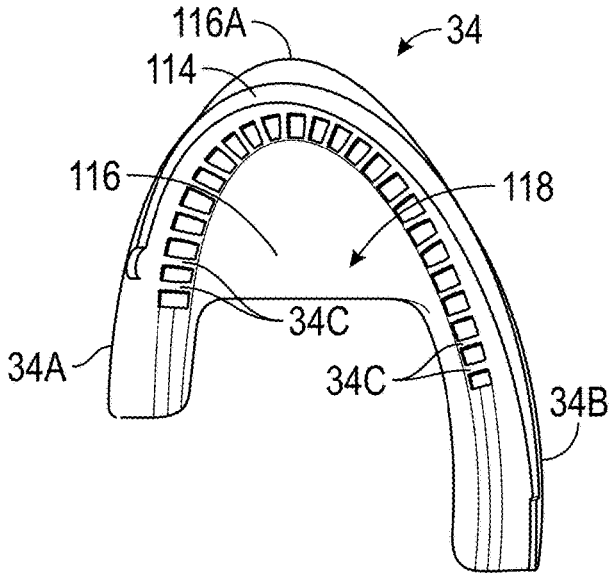
FIG. 27 is a top view of a toe support of the sole structure of the article of footwear of FIG. 1.

FIG. 4 is a medial side view of the article of footwear 10 of FIG. 1 showing the medial side 108 and FIG. 5 is a lateral side view of the article of footwear 10. It is apparent in FIGS. 4 and 5 that the forefoot midsole layer 28A and the heel midsole layer 28B wrap up onto the sides of the upper 12 above the plate 16. This is also apparent in the cross-sectional views of FIGS. 10, 11, and 13, which are taken at the lines shown in the top view of FIG. 6. FIG. 4 shows the forefoot midsole layer 28A and the heel midsole layer 28B wrapped up onto the medial side 108 of the article of footwear 10. FIG. 5 shows the forefoot midsole layer 28A and the heel midsole layer 28B wrapped up onto the lateral side 110 of the article of footwear 10. The medial side 108 and the lateral side 110 of the article of footwear 10 are also the medial side and the lateral side of the upper 12. The toe support 34 extends further rearward along the lateral side 110 of the upper 12 than along the medial side 108 of the upper 12, thus helping to distribute lateral forces over the plate 16. FIG. 27 best shows that the toe support 34 has a medial arm 34A and a lateral arm 34B, and that the lateral arm 34B extends further rearward than the medial arm 34A. The toe support 34 includes ribs 34C that reinforce the transition from a wall 114 of the toe support to a base 116 of the toe support at the foot-facing surface 118.

Figure 7:
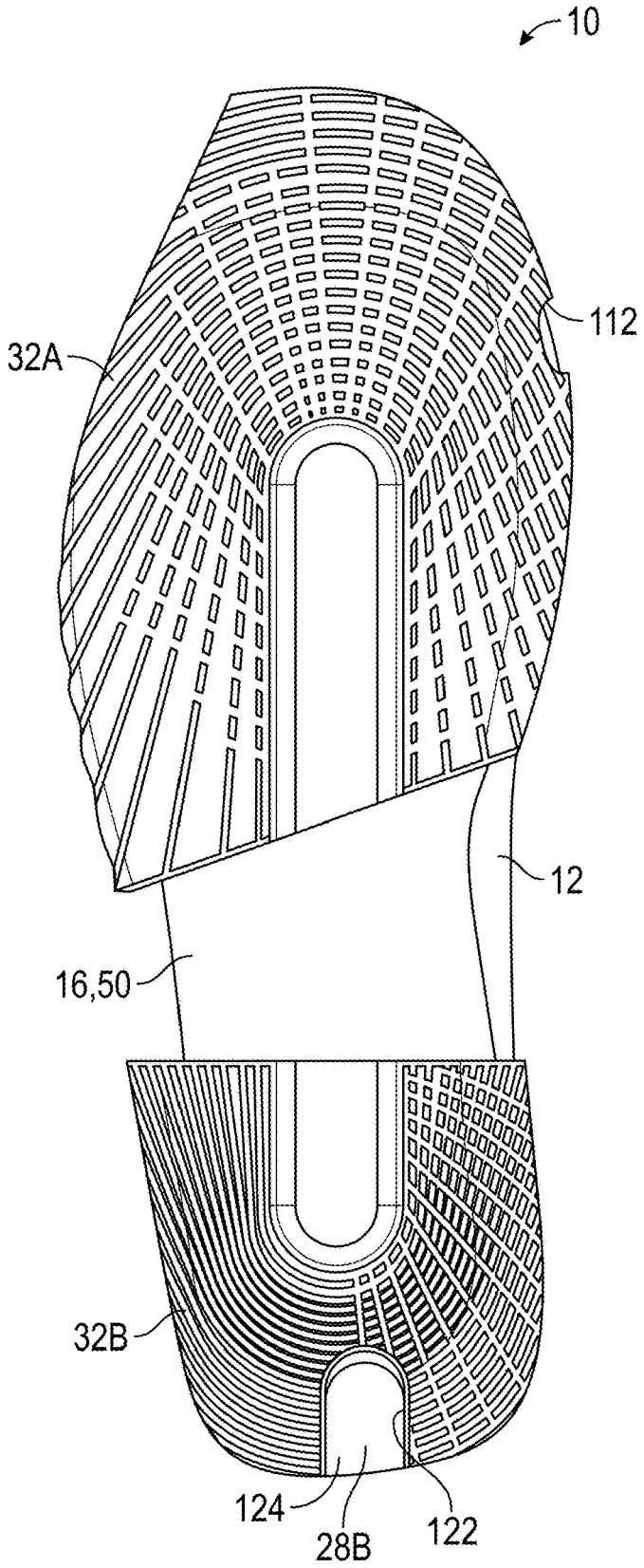
FIG. 7 is a bottom view of the article of footwear of FIG. 1.

The heel midsole layer 28B also wraps up the rear of the upper 12 at the heel region 44, as best shown in FIGS. 4-5. The front outsole element 32A includes a notch 112 generally in the vicinity of the metatarsal heads in the forefoot region 40 as shown in FIGS. 4 and 7. The notch 112 may be aligned with a pivot axis of the metatarsal heads at which the sole structure 14 bends in the forward roll leading up to toe-off. The forefoot midsole layer 28A is thinned at the notch 112 to further enhance flexibility of the sole structure 14 and enable bending at the notch 112.

Figure 28:
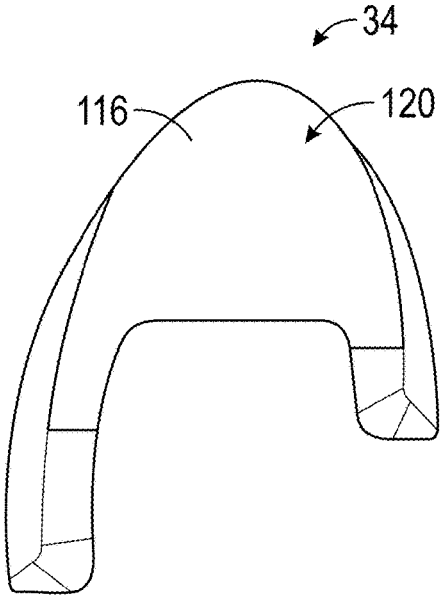
FIG. 28 is a bottom view of the toe support of FIG. 27.

FIGS. 4-6 also indicate that the toe support 34 has the wall 114 extending upward along the foremost extent 20 of the upper 12. As shown in FIG. 4, the wall 114 has a notch 115 generally disposed above the notch 112 of the front outsole element 32A to enable flexibility and bending of the sole structure 14 at the pivot axis of the wearer's metatarsal heads. Referring to FIGS. 1 and 27, the toe support 34 also has the base 116 from which the wall 114 extends. The base 116 has a forward ledge 116A that extends forward from the wall 114 over the foot-facing surface 54 of the plate 16 at the extension portion 16A to the forward end 58 of the plate 16. The base 116 also extends rearward of the wall 114 so that it is disposed over the forefoot portion 16B of the plate 16. A foot-facing surface 118 of the base 116 shown in FIGS. 3 and 27 generally follows the curvature C1 of the relatively curved forefoot portion 16B of the plate 16 as is shown in FIG. 3. A ground-facing surface 120 of the base 116 is shown in FIGS. 3 and 28, and is generally flat, following the curvature C2 of the relatively flat portion of the plate 16. Because the toes of the wearer rest over the base 116, the foot-facing surface 118 allows the wearer's toes to rest at a larger toe spring angle than the toe spring angle A2 of the extension portion 16A, further easing the forward roll. The toe support 34 may be a stiffer material than the upper 12, such as a thermoplastic polyurethane similar to the material of the first plate layer 50. Accordingly, the toe support 34 may help to distribute and direct longitudinal bending forces over the plate 16.

Figure 9:
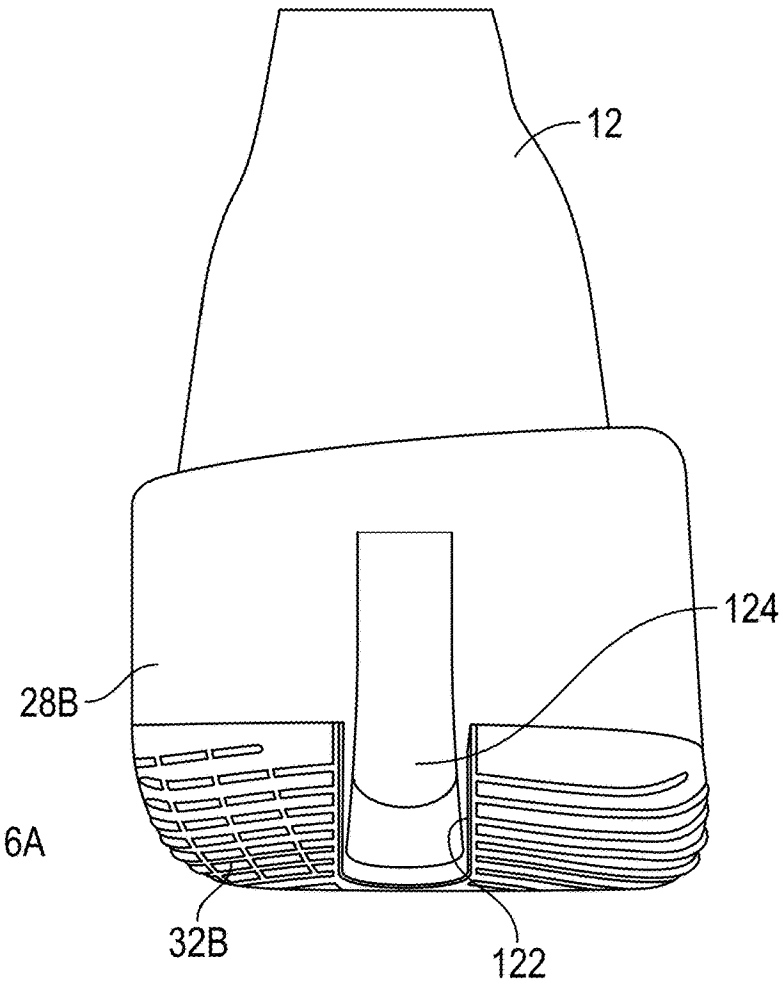
FIG. 9 is a rear view of the article of footwear of FIG. 1.
Figure 8:
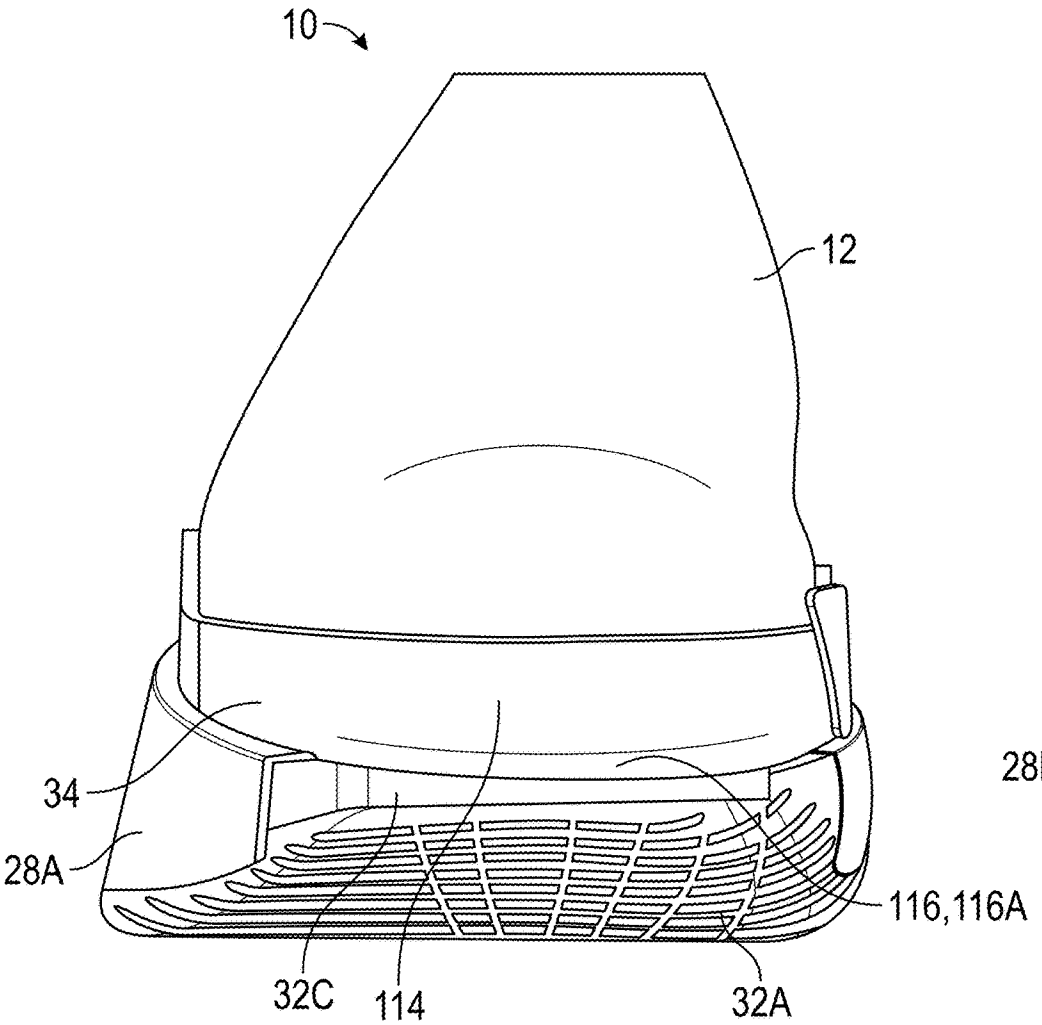
FIG. 8 is a front view of the article of footwear of FIG. 1.

FIGS. 7-9 show the bottom, front, and rear views, respectively, of the article of footwear 10, and illustrate the outsole elements 32A, 32B, and 32C. The toe outsole element 32C extends over the forward end of the forward ledge 116A and onto the end of the front outsole element 32A, as shown in FIG. 1. As is apparent in FIGS. 7 and 9, the heel outsole element 32B includes a rear notch 122 that aligns with a rear depression 124 on the heel midsole layer 28B. The depression 124 increases compressibility of the heel region 44 by allowing the heel midsole layer 28B to deform without constriction of the heel outsole element 32B at the depression 124.

Figure 14:
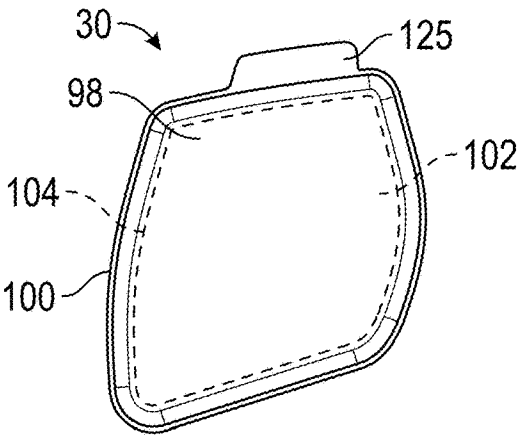
FIG. 14 is a bottom view of a forefoot bladder included in the sole structure of the article of footwear of FIG. 1.

Referring to FIG. 14, the bottom of the forefoot bladder 30 is shown with the second polymeric sheet 98 and the peripheral flange 100. A portion 125 of the peripheral flange 100 is larger, and may include a fill port that has been sealed after inflating the chamber 102 with fluid. The periphery of the tensile component 104 within the chamber 102 is shown in phantom.

Figure 15:
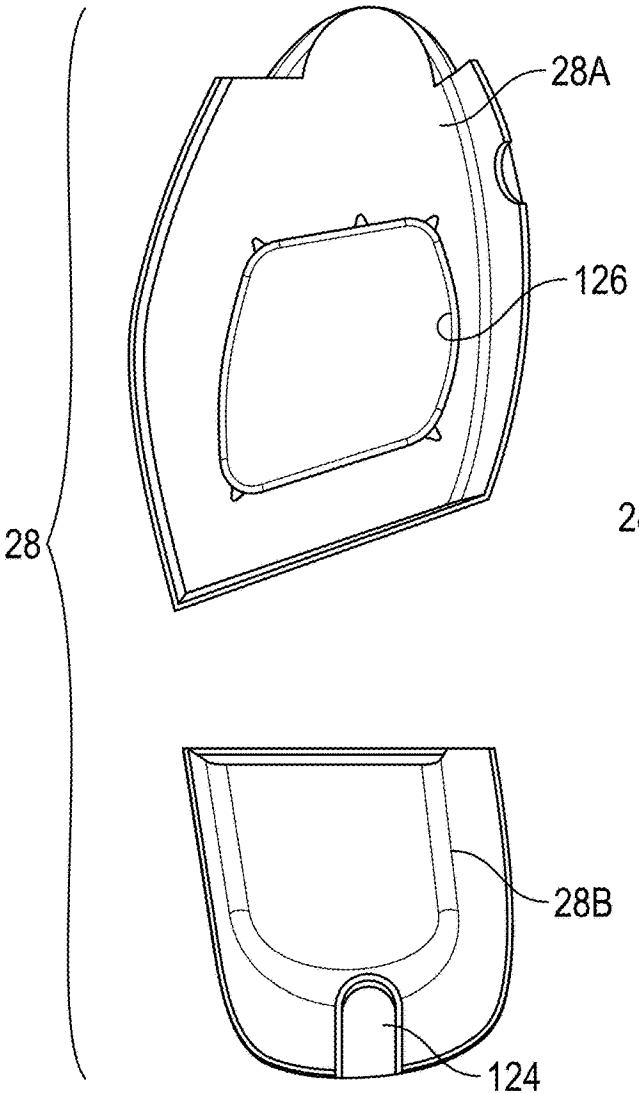
FIG. 15 is a bottom view of a midsole of the sole structure of the article of footwear of FIG. 1 including a forefoot midsole layer and a heel midsole layer.

FIG. 15 is a bottom view of the midsole 28 of the sole structure 14 of the article of footwear 10. The forefoot midsole layer 28A has a recess 126 having a depth and shape corresponding with that of the forefoot bladder 30, which is nested in the recess 126 as shown in FIG. 11. The heel midsole layer 28B is shown with the depression 124.

Figure 10:
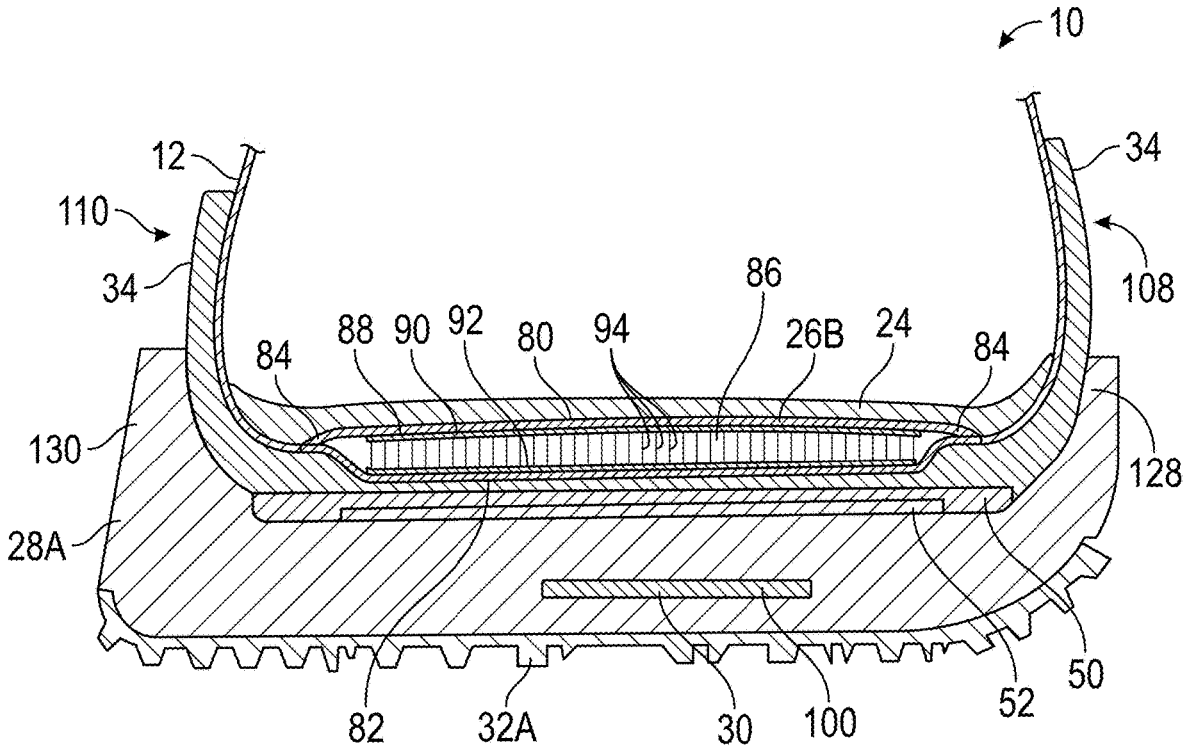
FIG. 10 is a cross-sectional and partially fragmentary view of the article of footwear of FIG. 1 taken at lines 10-10 in FIG. 6.
Figure 13:
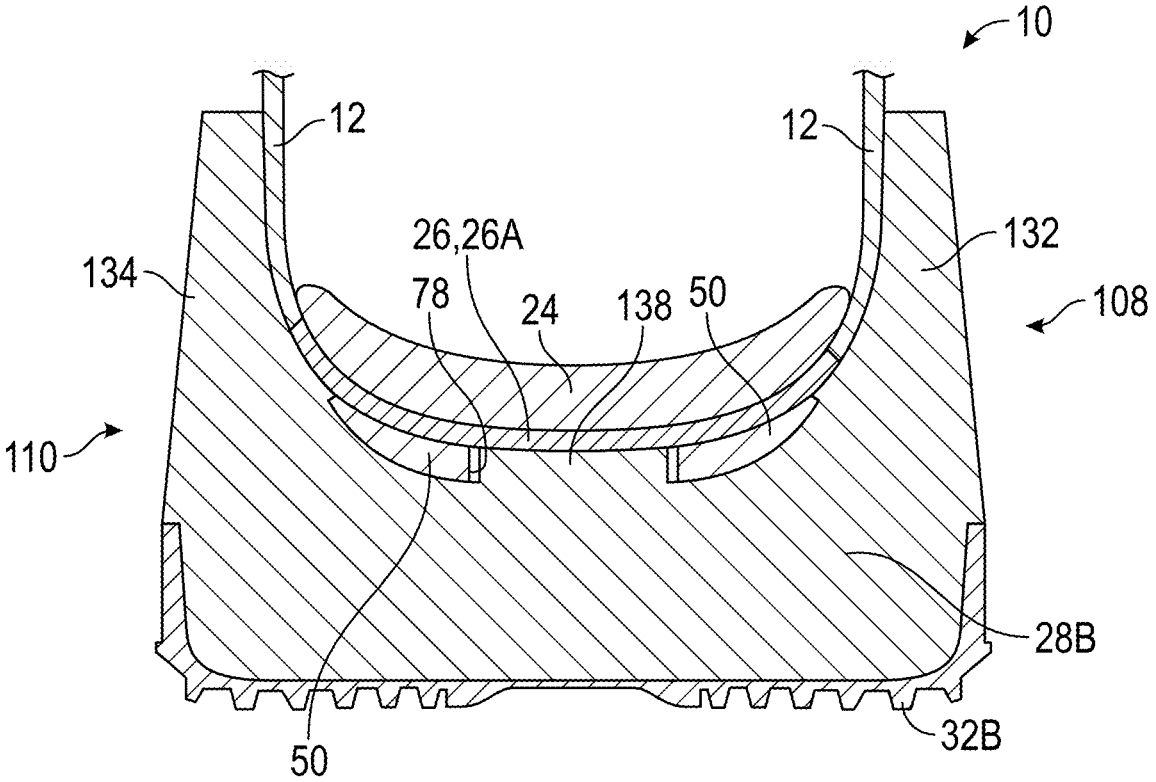
FIG. 13 is a cross-sectional and partially fragmentary view of the article of footwear of FIG. 1 taken at lines 13-13 in FIG. 6.
Figure 16:
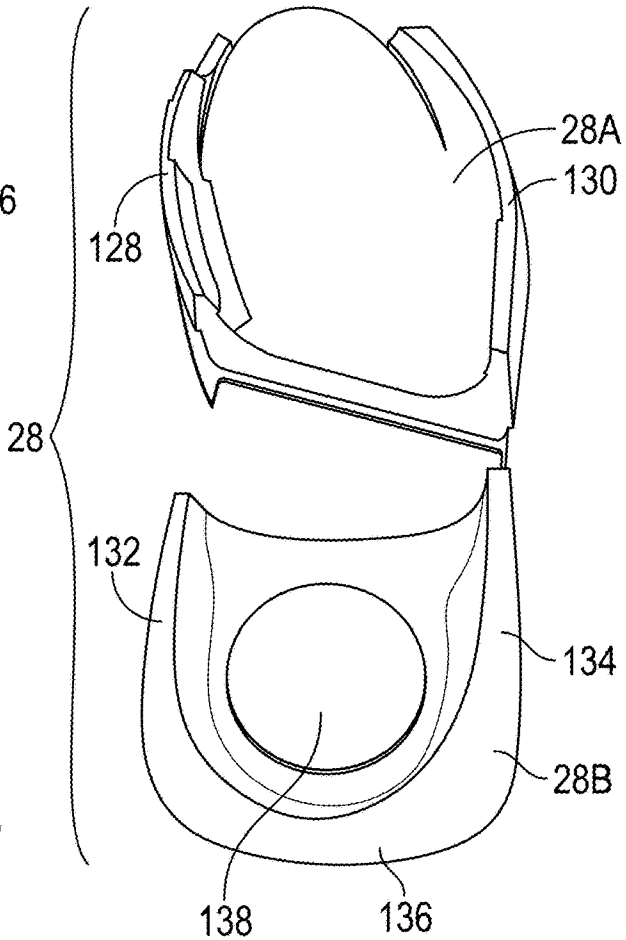
FIG. 16 is a top perspective view of the midsole of FIG. 15.

FIG. 16 is a top perspective view of the midsole 28 of FIG. 15. The forefoot midsole layer 28A has a medial side wall 128 that extends up the medial side 108 of the upper 12 as shown in FIG. 10, for example. The forefoot midsole layer 28A also has a lateral side wall 130 that extends up the lateral side 110 of the upper 12. The heel midsole layer 28B has a similar medial side wall 132 that extends up the medial side 108 of the upper 12 as shown in FIG. 13, for example. The heel midsole layer 28B also has a lateral side wall 134 that extends up the lateral side 110 of the upper 12. The heel midsole layer 28B has a rear wall 136 that connects the medial side wall 132 and the lateral side wall 134 and extends up the rear of the upper 12 as shown in FIG. 1. The protruding portion 138 of the heel midsole layer 28B that fills the through hole 78 as shown in FIG. 13 is also apparent in FIG. 16.

Figure 17:
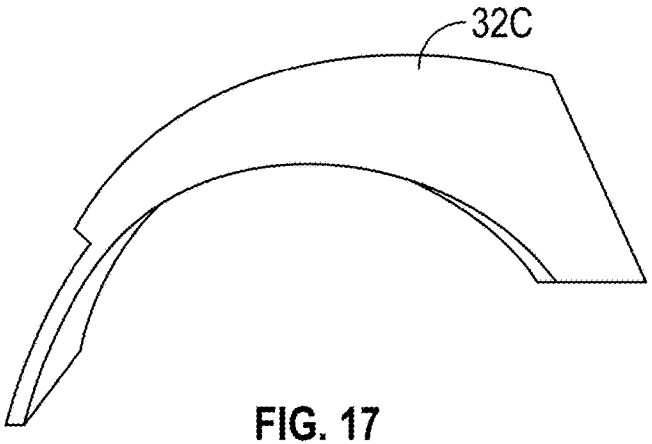
FIG. 17 is a top view of a toe outsole element of the sole structure of the article of footwear of FIG. 1.
Figure 18:
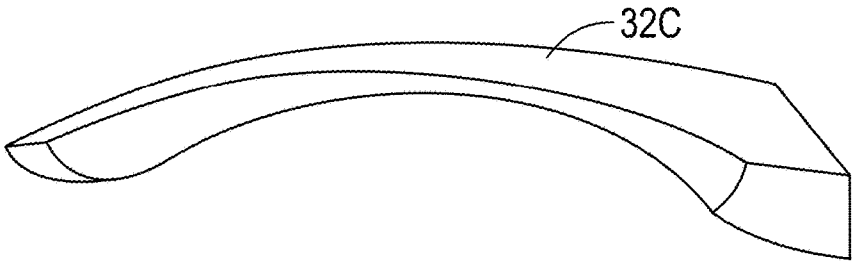
FIG. 18 is a perspective view of the toe outsole element of FIG. 17.

FIG. 17 is a top view of the toe outsole element 32C of the sole structure 14 of the article of footwear 10 of FIG. 1, and FIG. 18 is a rear perspective view of the toe outsole element 32C.

Figure 19:
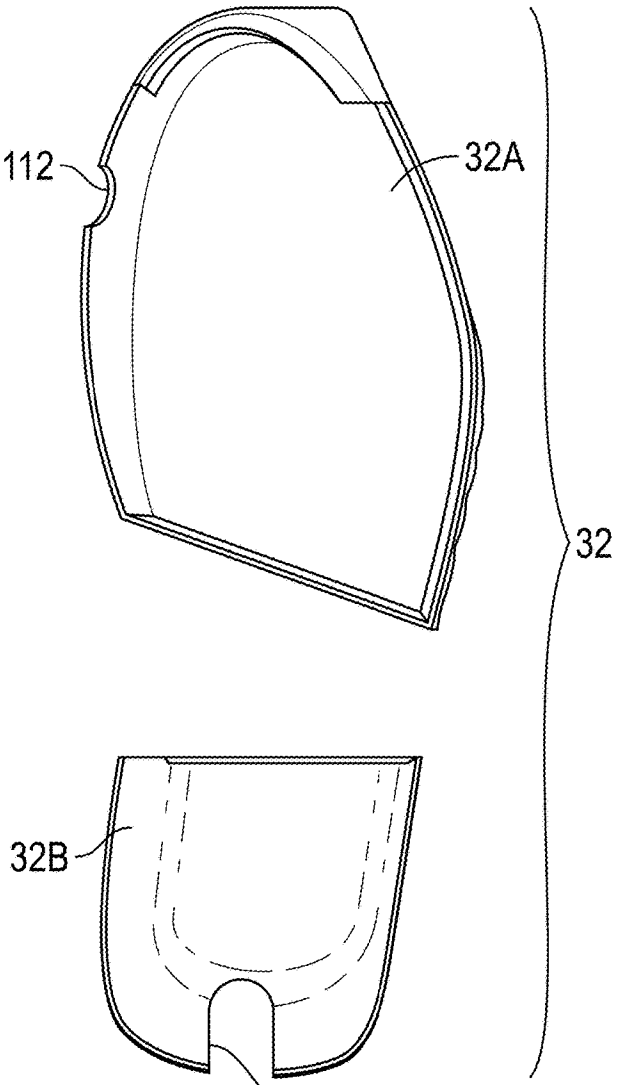
FIG. 19 is a top view of an outsole of the sole structure of the article of footwear of FIG. 1 including a forefoot outsole element and a heel outsole element.

FIG. 19 is a top view of the outsole 32 of the sole structure 14 of the article of footwear 10 of FIG. 1 including the forefoot outsole element 32A and the heel outsole element 32B. The notch 112 of the forefoot outsole element 32A and the notch 122 of the heel outsole element 32B previously discussed herein are shown.

Figure 22:
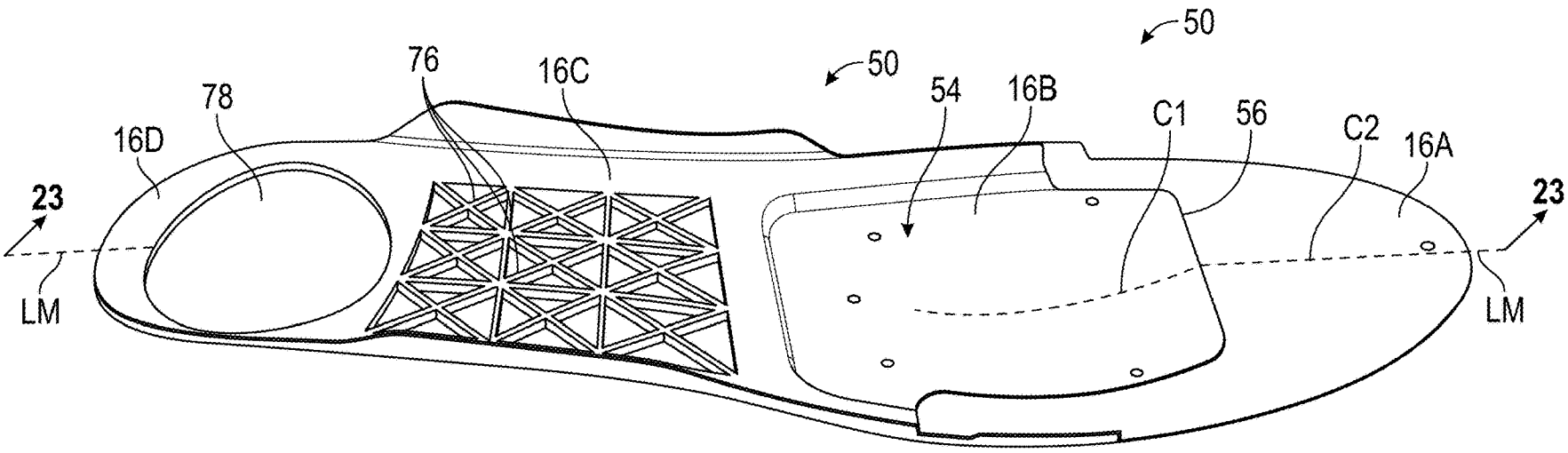
FIG. 22 is a perspective view of the first plate layer of FIG. 21.
Figure 23:
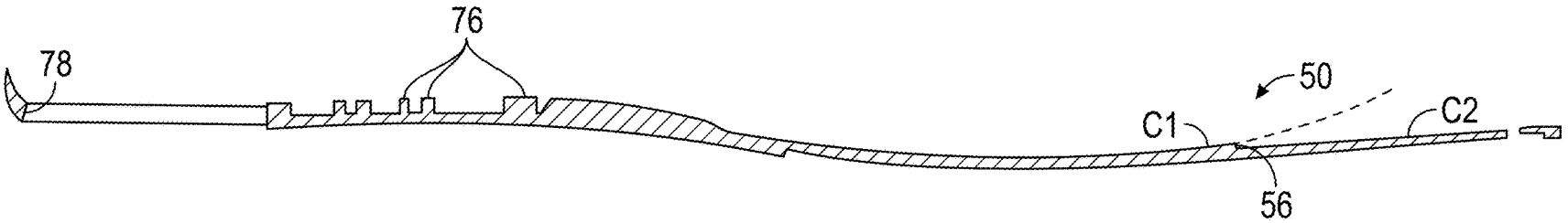
FIG. 23 is a cross-sectional view of the first plate layer of FIG. 22 taken at lines 23-23 in FIG. 22.

FIGS. 20 and 21 show top and bottom views, respectively, of the first plate layer 50, as previously discussed. FIG. 22 is a perspective view of the first plate layer of FIGS. 20 and 21. The curvatures C1 and C2 and the transition line 56 are shown. The upwardly-extending protrusions 76 as well as the through hole 78 are evident. FIG. 23 is a cross-sectional view of the first plate layer 50 of FIG. 23 taken at lines 23-23 in FIG. 22 and also shows these same features.

Figure 24:
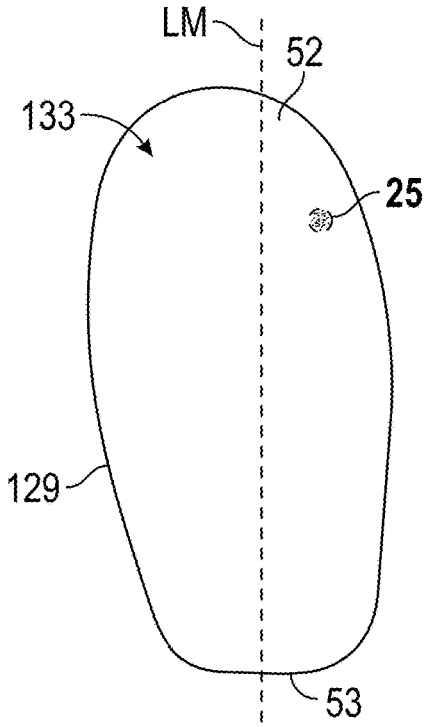
FIG. 24 is a top view of the second plate layer included in the sole structure of the article of footwear of FIG. 1.
Figure 25:
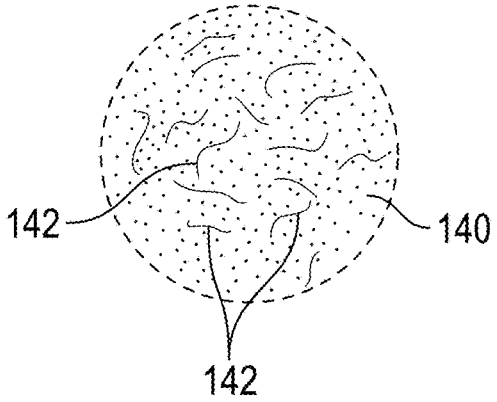
FIG. 25 is a closeup view of a base material and carbon fibers of the second plate layer of FIG. 24.

FIG. 24 is a top view of a second plate layer 52 of the plate 16 of the sole structure 14 of the article of footwear 10 of FIG. 1. The outer perimeter 129 of the second plate layer 52 matches the perimeter 131 of the recess 66 of FIG. 21 (when the second plate layer 52 is inverted relative to its position in FIG. 24 so that the top surface 133 of the second plate layer 52 interfaces with the ground-facing surface 68 of the first plate layer 50 in the recess 66.

Figure 26:
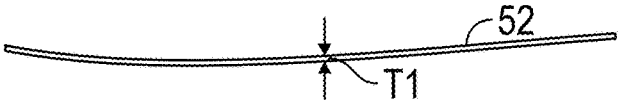
FIG. 26 is a lateral side view of the second plate layer of FIG. 25.

Although the first and second plate layers 50, 52 may be the same material, in one or more embodiments, the first plate layer 50 may be a first material, and the second plate layer 52 may be a second material different than the first material. In an example, the first material of the first plate layer 50 may comprise thermoplastic polyurethane and the second material of the second plate layer 52 may comprise a carbon fiber composite. The second plate layer 52 is a composite material in the embodiment shown. In the closeup view of FIG. 25, the composite material is shown as including a base material 140 and carbon fibers 142 disposed within the base material 140. In an implementation, an elastic modulus of the base material 140 may be from about 2 gigapascals (GPa) to about 130 GPa under flex loading along a longitudinal midline LM of the second plate layer 52. The longitudinal midline LM of the second plate layer 52 is the same as the longitudinal midline LM of the article of footwear 10 shown in FIG. 6, for example. In a more specific example, the elastic modulus of the base material may be from about 104 GPa to about 108 GPa under axial loading and about 120 GPa under flex loading along the longitudinal midline when the base material 140 has a thickness T1 shown in FIG. 26 of about 1.125 millimeters. FIG. 26 is a lateral side view of the second plate layer 52 of FIG. 25 and shows the thickness T1. The second plate layer 52 has a uniform thickness T1 throughout. The toe support 34 shown in FIGS. 27 and 28 includes the features previously discussed with respect to FIG. 1.

Figure 29:
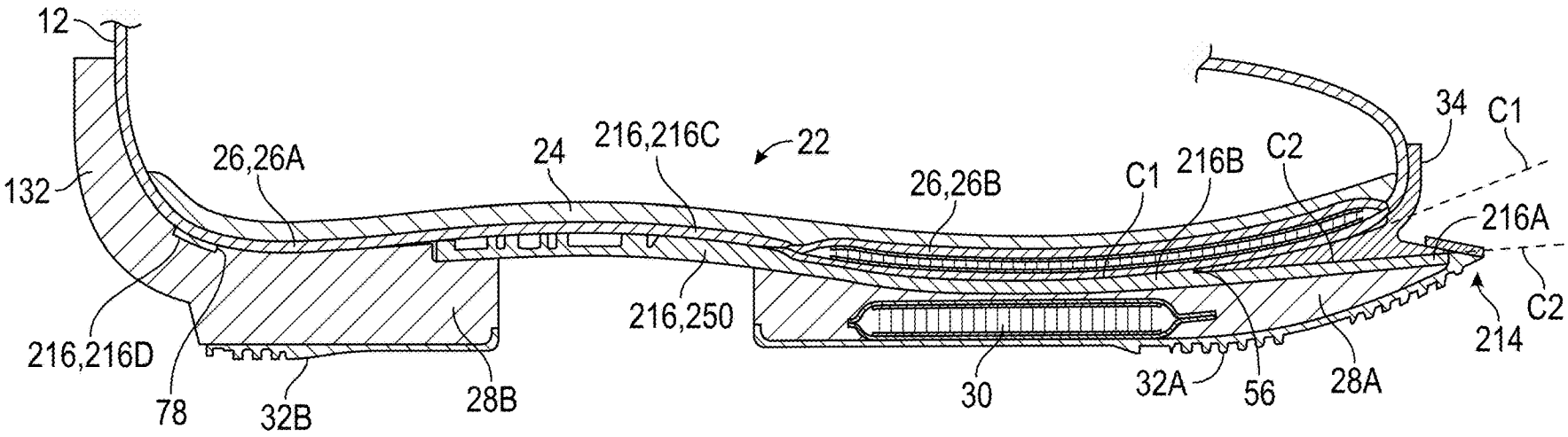
FIG. 29 is a cross-sectional and partially fragmentary view of an alternative embodiment of an article of footwear having a sole structure with a different plate.

FIG. 29 is a cross-sectional and partially fragmentary view of an alternative embodiment of an article of footwear 210 having a sole structure 214 with a different plate 216. The article of footwear 210 is alike in all aspects to the article of footwear 10 except that the plate 216 is a single layer and may be referred to as plate layer 250. For example, the plate layer 250 includes all of the features of the first plate layer 50 except that there is no recess 66 and, accordingly, the sole structure 214 does not include a second plate layer. Like the first plate layer 50 of the article of footwear 10, the plate 216 has a forefoot portion 216B with a first curvature C1 and an extension portion 216A with a second curvature C2 that begins at a transition line 56. A midfoot portion 216C has the same features as the midfoot portion 16C and the heel portion 216D has the same features as the heel portion 16D.

Figure 30:
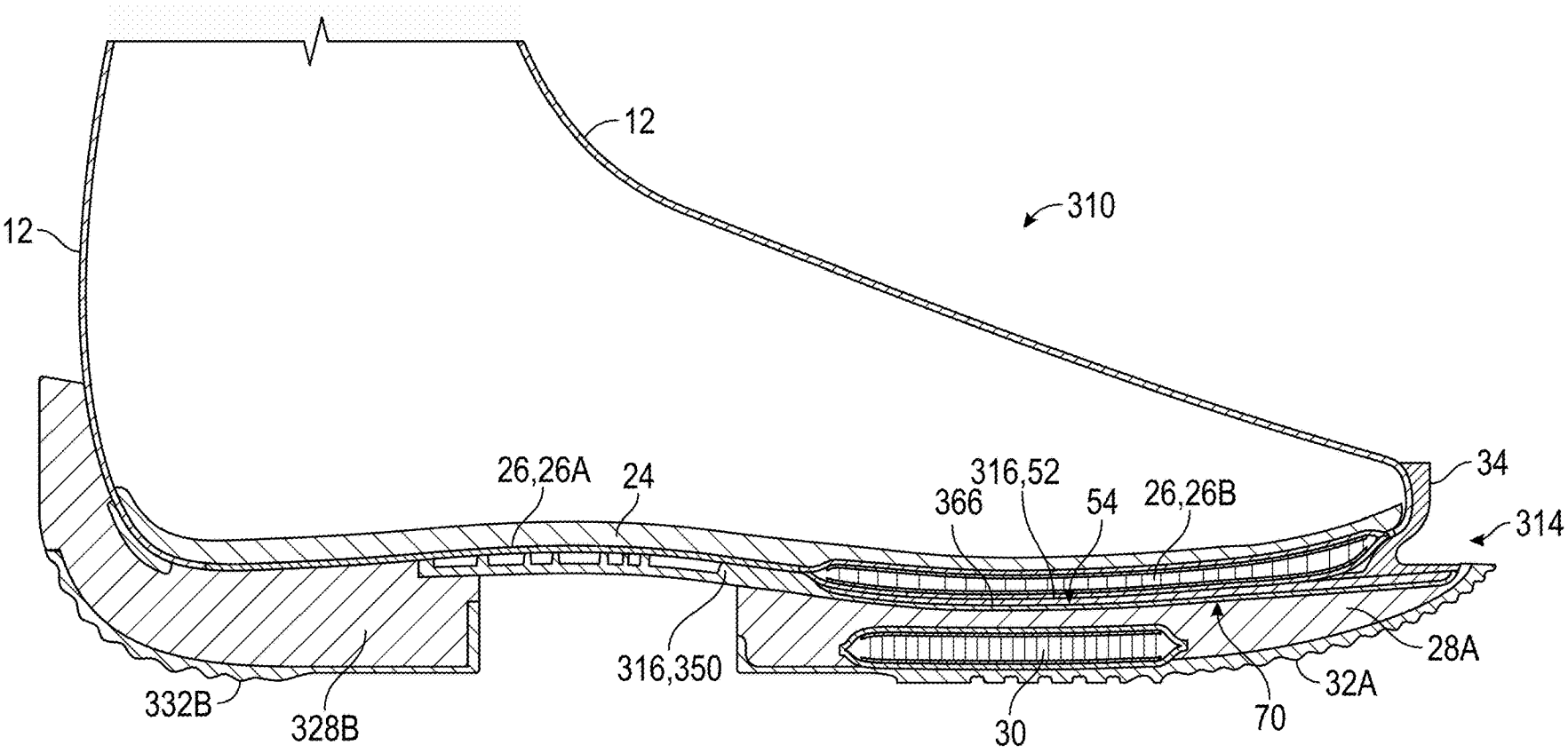
FIG. 30 is a cross-sectional and partially fragmentary view of another alternative embodiment of an article of footwear having a sole structure with a different plate.

FIG. 30 is a cross-sectional view of another alternative embodiment of an article of footwear 310 having a sole structure 314 with a different plate 316. The article of footwear 310 is alike in all aspects to the article of footwear 10 except that the plate 316 has a first plate layer 350 with a recess 366 in the foot-facing surface 54 rather than a recess 66 in the ground-facing surface 70, and the heel midsole layer 328B and heel outsole element 332B are used in place of heel midsole layer 28B and heel outsole element 32B. Because the recess 366 is in the foot-facing surface 54, the second plate layer 52 is disposed above the first plate layer 350. With the relatively stiffer second plate layer 52 higher in the sole structure 314 than in the sole structure 14, the neutral bending axis of the sole structure 314 may be higher than that of the sole structure 14. The second plate layer 52 interfaces with the first plate layer 350 in the recess 366 in that a bottom surface (e.g., a ground-facing surface) of the second plate layer 52 is disposed against a top surface (e.g., a foot-facing surface) of the first plate layer 350.

Figure 31:
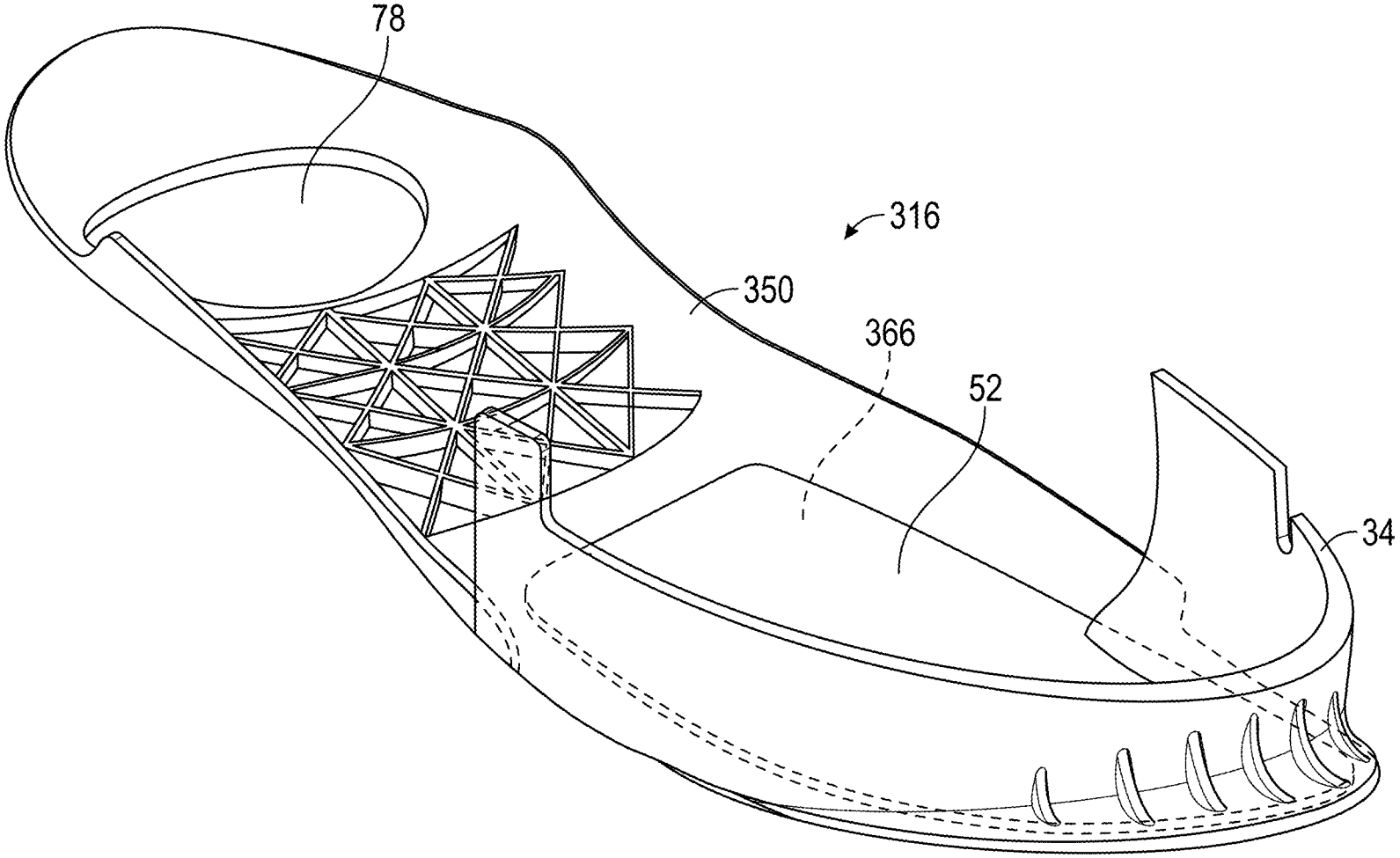
FIG. 31 is a perspective view of a plate included in the sole structure of the article of footwear of FIG. 30, the plate having a first plate layer and a second plate layer, and showing a toe support secured to the plate.

FIG. 31 is a perspective view of the plate 316 showing the second plate layer 52 disposed above the first plate layer 350 in the recess 366 and otherwise having the same features as described with respect to first plate layer 50. The toe support 34 is also shown.

Referring again to FIG. 30, the heel midsole layer 328B is thicker at the rear of the heel region 44 than the heel midsole layer 28B, and the heel outsole element 332B extends further up the rear of the heel midsole layer 328B than the heel outsole element 32B extends up on the heel midsole layer 28B.

The following Clauses provide example configurations of an article of footwear disclosed herein.

Clause 1. An article of footwear comprising: an upper; and a sole structure including: a plate having a heel portion, a midfoot portion, a forefoot portion, and an extension portion, the extension portion extending forward of the forefoot portion and forward of a foremost extent of upper; wherein the plate includes a first plate layer establishing an outer surface of the plate and extending in each of the heel portion, the midfoot portion, the forefoot portion, and the extension portion, and a second plate layer interfacing with the first plate layer and extending in the forefoot portion and the extension portion; and wherein a bending stiffness of the second plate layer is greater than a bending stiffness of the first plate layer.

Clause 2. The article of footwear of clause 1, wherein the first plate layer defines a recess; and wherein the second plate layer is nested in the recess of the first plate layer.

Clause 3. The article of footwear of clause 2, wherein the recess is in a foot-facing surface of the first plate layer.

Clause 4. The article of footwear of clause 2, wherein the recess is in a ground-facing surface of the first plate layer.

Clause 5. The article of footwear of clause 2, wherein an outer surface of the second plate layer is flush with the outer surface of the first plate layer both forward of the recess and rearward of the recess.

Clause 6. The article of footwear of any of clauses 1-5, wherein the first plate layer is a first material, and the second plate layer is a second material different than the first material.

Clause 7. The article of footwear of clause 6, wherein the first material comprises thermoplastic polyurethane and the second material comprises a carbon fiber composite.

Clause 8. The article of footwear of clause 7, wherein the carbon fiber composite includes: a base material; and carbon fibers disposed within the base material; wherein an elastic modulus of the base material is from about 2 gigapascals (GPa) to about 130 GPa under flex loading along a longitudinal midline of the second plate layer.

Clause 9. The article of footwear of clause 8, wherein the elastic modulus of the base material is from about 104 GPa to about 108 GPa under axial loading and is about 120 GPa under flex loading along the longitudinal midline and the base material has a thickness of about 1.125 millimeters.

Clause 10. The article of footwear of any of clauses 1-5, wherein the plate transitions along a longitudinal midline of the plate from relatively curved to relatively flat in the forefoot portion and remains relatively flat in the extension portion.

Clause 11. The article of footwear of any of clauses 1-5, wherein a curvature of the plate along a longitudinal midline of the plate is greater in the forefoot portion than in the extension portion.

Clause 12. The article of footwear of any of clauses 1-5, wherein a toe spring angle of the extension portion is less than or equal to 12 degrees.

Clause 13. The article of footwear of clause 12, wherein a ground-contact surface of the sole structure underlying the extension portion of the plate has a toe spring angle greater than the toe spring angle of the extension portion of the plate.

Clause 14. The article of footwear of clause 12, wherein a ratio of a length of the extension portion along a longitudinal midline of the plate to a length of the plate along the longitudinal midline of the plate is from 0.25 to 0.35.

Clause 15. The article of footwear of any of clauses 1-5, wherein a foot-facing surface of the plate in the midfoot portion includes upwardly-extending and transversely-elongated protrusions for torsional rigidity.

Clause 16. The article of footwear of any of clauses 1-5, wherein the sole structure includes: a forefoot midsole layer secured to a ground-facing surface of the plate at the forefoot portion of the plate; and a heel midsole layer secured to the ground-facing surface of the plate at the heel portion of the plate and spaced apart from the forefoot midsole layer so that the ground-facing surface of the plate at the midfoot portion of the plate is exposed between the forefoot midsole layer and the heel midsole layer.

Clause 17. The article of footwear of any of clauses 1-5, wherein the plate defines a through hole extending through the plate from a foot-facing surface of the plate to a ground-facing surface of the plate at the heel portion of the plate.

Clause 18. The article of footwear of clause 17, wherein the sole structure further includes a midsole layer underlying the plate at the through hole.

Clause 19. The article of footwear of any of clauses 1-5, wherein the sole structure further includes a bladder defining a sealed, fluid-filled chamber underlying the forefoot portion of the plate.

Clause 20. The article of footwear of clause 19, wherein the sole structure further includes a midsole layer underlying the plate; and wherein the midsole layer is disposed between the plate and the bladder.

Clause 21. The article of footwear of any of clauses 1-5, wherein the sole structure further includes a toe support extending over a foot-facing surface of the extension portion and having a wall extending upward along the foremost extent of the upper.

Clause 22. The article of footwear of clause 21, wherein the wall of the toe support further extends along a medial side of the upper in a forefoot region of the article of footwear and along a lateral side of the upper in the forefoot region of the article of footwear.

Clause 23. The article of footwear of clause 22, wherein the toe support extends further rearward along the lateral side of the upper than along the medial side of the upper.

Clause 24. The article of footwear of any of clauses 1-5, further comprising: a strobel that includes: a bladder that defines a sealed, fluid-filled chamber in a forefoot region of the article of footwear, the bladder overlying the plate; and a lasting component secured to the upper and to the bladder and extending in a midfoot region and a heel region of the article of footwear.

Clause 25. An article of footwear comprising: an upper; and a sole structure including: a plate having a heel portion, a midfoot portion, a forefoot portion, and an extension portion, the extension portion extending forward of the forefoot portion and forward of a foremost extent of the upper; and at least one sole layer underlying the extension portion of the plate and establishing a ground-contact surface of the sole structure; wherein a toe spring angle of the sole structure at the ground-contact surface underlying the extension portion of the plate is greater than a toe spring angle of the extension portion of the plate.

Clause 26. The article of footwear of clause 25, wherein the plate transitions along a longitudinal midline of the plate from relatively curved to relatively flat in the forefoot portion and remains relatively flat in the extension portion.

Clause 27. The article of footwear of clause 25, wherein a curvature of the plate along a longitudinal midline of the plate is greater in the forefoot portion than in the extension portion.

Clause 28. The article of footwear of any of clauses 25-27, wherein a ratio of a length of the extension portion along a longitudinal midline of the plate to a length of the plate along the longitudinal midline of the plate is from 0.25 to 0.35.

Clause 29. The article of footwear of any of clauses 25-27, wherein a foot-facing surface of the plate in the midfoot portion includes upwardly-extending and transversely-elongated protrusions for torsional rigidity.

Clause 30. The article of footwear of any of clauses 25-27, wherein the sole structure includes: a forefoot midsole layer secured to a ground-facing surface of the plate at the forefoot portion of the plate; and a heel midsole layer secured to the ground-facing surface of the plate at the heel portion of the plate and spaced apart from the forefoot midsole layer so that the ground-facing surface of the plate at the midfoot portion of the plate is exposed between the forefoot midsole layer and the heel midsole layer.

Clause 31. The article of footwear of any of clauses 25-27, wherein the plate defines a through hole extending through the plate from a foot-facing surface of the plate to a ground-facing surface of the plate at the heel portion of the plate.

Clause 32. The article of footwear of clause 31, wherein the sole structure further includes a midsole layer underlying the plate at the through hole.

Clause 33. The article of footwear of any of clauses 25-27, wherein the sole structure further includes a bladder defining a sealed, fluid-filled chamber underlying the forefoot portion of the plate.

Clause 34. The article of footwear of clause 33, wherein the sole structure further includes a midsole layer underlying the plate; and wherein the midsole layer is disposed between the plate and the bladder.

Clause 35. The article of footwear of any of clauses 25-27, wherein the sole structure further includes a toe support extending over a foot-facing surface of the extension portion and having a wall extending upward along the foremost extent of the upper.

Clause 36. The article of footwear of clause 35, wherein the wall of the toe support further extends along a medial side of the upper in a forefoot region of the article of footwear and along a lateral side of the upper in the forefoot region of the article of footwear.

Clause 37. The article of footwear of clause 36, wherein the toe support extends further rearward along the lateral side of the upper than along the medial side of the upper.

Clause 38. The article of footwear of any of clauses 25-27, further comprising: a strobel that includes: a bladder that defines a sealed, fluid-filled chamber in a forefoot region of the article of footwear, the bladder overlying the plate; and a lasting component secured to the upper and to the bladder and extending in a midfoot region and a heel region of the article of footwear.

To assist and clarify the description of various embodiments, various terms are defined herein. Unless otherwise indicated, the following definitions apply throughout this specification (including the claims). Additionally, all references referred to are incorporated herein in their entirety.

An "article of footwear", a "footwear article of manufacture", and "footwear" may be considered to be both a machine and a manufacture. Assembled, ready to wear footwear articles (e.g., shoes, sandals, boots, etc.), as well as discrete components of footwear articles (such as a midsole, an outsole, an upper component, etc.) prior to final assembly into ready to wear footwear articles, are considered and alternatively referred to herein in either the singular or plural as "article(s) of footwear".

"A", "an", "the", "at least one", and "one or more" are used interchangeably to indicate that at least one of the items is present. A plurality of such items may be present unless the context clearly indicates otherwise. All numerical values of parameters (e.g., of quantities or conditions) in this specification, unless otherwise indicated expressly or clearly in view of the context, including the appended claims, are to be understood as being modified in all instances by the term "about" whether or not "about" actually appears before the numerical value. "About" indicates that the stated numerical value allows some slight imprecision (with some approach to exactness in the value; approximately or reasonably close to the value; nearly). If the imprecision provided by "about" is not otherwise understood in the art with this ordinary meaning, then "about" as used herein indicates at least variations that may arise from ordinary methods of measuring and using such parameters. In addition, a disclosure of a range is to be understood as specifically disclosing all values and further divided ranges within the range.

The terms "comprising", "including", and "having" are inclusive and therefore specify the presence of stated features, steps, operations, elements, or components, but do not preclude the presence or addition of one or more other features, steps, operations, elements, or components. Orders of steps, processes, and operations may be altered when possible, and additional or alternative steps may be employed. As used in this specification, the term "or" includes any one and all combinations of the associated listed items. The term "any of" is understood to include any possible combination of referenced items, including "any one of" the referenced items. The term "any of" is understood to include any possible combination of referenced claims of the appended claims, including "any one of" the referenced claims.

For consistency and convenience, directional adjectives may be employed throughout this detailed description corresponding to the illustrated embodiments. Those having ordinary skill in the art will recognize that terms such as "above", "below", "upward", "downward", "top", "bottom", etc., may be used descriptively relative to the figures, without representing limitations on the scope of the invention, as defined by the claims.

The term "longitudinal" particularly refers to a direction extending a length of a component. For example, a longitudinal direction of a shoe extends between a forefoot region and a heel region of the shoe. The term "forward" or "anterior" is used to particularly refer to the general direction from a heel region toward a forefoot region, and the term "rearward" or "posterior" is used to particularly refer to the opposite direction, i.e., the direction from the forefoot region toward the heel region. In some cases, a component may be identified with a longitudinal axis as well as a forward and rearward longitudinal direction along that axis. The longitudinal direction or axis may also be referred to as an anterior-posterior direction or axis.

The term "transverse" particularly refers to a direction extending a width of a component. For example, a transverse direction of a shoe extends between a lateral side and a medial side of the shoe. The transverse direction or axis may also be referred to as a lateral direction or axis or a mediolateral direction or axis.

The term "vertical" particularly refers to a direction generally perpendicular to both the lateral and longitudinal directions. For example, in cases where a sole is planted flat on a ground surface, the vertical direction may extend from the ground surface upward. It will be understood that each of these directional adjectives may be applied to individual components of a sole. The term "upward" or "upwards" particularly refers to the vertical direction pointing towards a top of the component, which may include an instep, a fastening region and/or a throat of an upper. The term "downward" or "downwards" particularly refers to the vertical direction pointing opposite the upwards direction, toward the bottom of a component and may generally point towards the bottom of a sole structure of an article of footwear.

The "interior" of an article of footwear, such as a shoe, particularly refers to portions at the space that is occupied by a wearer's foot when the shoe is worn. The "inner side" of a component particularly refers to the side or surface of the component that is (or will be) oriented toward the interior of the component or article of footwear in an assembled article of footwear. The "outer side" or "exterior" of a component particularly refers to the side or surface of the component that is (or will be) oriented away from the interior of the shoe in an assembled shoe. In some cases, other components may be between the inner side of a component and the interior in the assembled article of footwear. Similarly, other components may be between an outer side of a component and the space external to the assembled article of footwear. Further, the terms "inward" and "inwardly" particularly refer to the direction toward the interior of the component or article of footwear, such as a shoe, and the terms "outward" and "outwardly" particularly refer to the direction toward the exterior of the component or article of footwear, such as the shoe. In addition, the term "proximal" particularly refers to a direction that is nearer a center of a footwear component, or is closer toward a foot when the foot is inserted in the article of footwear as it is worn by a user. Likewise, the term "distal" particularly refers to a relative position that is further away from a center of the footwear component or is further from a foot when the foot is inserted in the article of footwear as it is worn by a user. Thus, the terms proximal and distal may be understood to provide generally opposing terms to describe relative spatial positions.

While various embodiments have been described, the description is intended to be exemplary, rather than limiting and it will be apparent to those of ordinary skill in the art that many more embodiments and implementations are possible that are within the scope of the embodiments. Any feature of any embodiment may be used in combination with or substituted for any other feature or element in any other embodiment unless specifically restricted. Accordingly, the embodiments are not to be restricted except in light of the attached claims and their equivalents. Also, various modifications and changes may be made within the scope of the attached claims.

While several modes for carrying out the many aspects of the present teachings have been described in detail, those familiar with the art to which these teachings relate will recognize various alternative aspects for practicing the present teachings that are within the scope of the appended claims. It is intended that all matter contained in the above description or shown in the accompanying drawings shall be interpreted as illustrative and exemplary of the entire range of alternative embodiments that an ordinarily skilled artisan would recognize as implied by, structurally and/or functionally equivalent to, or otherwise rendered obvious based upon the included content, and not as limited solely to those explicitly depicted and/or described embodiments.

What is claimed is:

1. An article of footwear comprising:

an upper; and a sole structure including:

a plate having a heel portion, a midfoot portion, a forefoot portion, and an extension portion, the extension portion extending forward of the forefoot portion and forward of a foremost extent of the upper; and at least one sole layer underlying the extension portion of the plate and establishing a ground-contact surface of the sole structure;

wherein a toe spring angle of the sole structure at the ground-contact surface that is forward of the foremost extent of the upper and that is underlying the extension portion of the plate is greater than a toe spring angle of the extension portion of the plate.

2. The article of footwear of claim 1, wherein along a longitudinal midline of the plate, the plate transitions in the forefoot portion from a curved portion to a flat portion, and the flat portion continues in the extension portion.

3. The article of footwear of claim 1, wherein a curvature of the plate along a longitudinal midline of the plate is greater in the forefoot portion than in the extension portion.

4. The article of footwear of claim 1, wherein a ratio of a length of the extension portion along a longitudinal midline of the plate to a length of the plate along the longitudinal midline of the plate is from 0.25 to 0.35.

5. The article of footwear of claim 1, wherein a foot-facing surface of the plate in the midfoot portion includes upwardly-extending and transversely-elongated protrusions for torsional rigidity.

6. The article of footwear of claim 1, wherein the sole structure includes:

a forefoot midsole layer secured to a ground-facing surface of the plate at the forefoot portion of the plate; and a heel midsole layer secured to the ground-facing surface of the plate at the heel portion of the plate and spaced apart from the forefoot midsole layer so that the ground-facing surface of the plate at the midfoot portion of the plate is exposed between the forefoot midsole layer and the heel midsole layer.

7. The article of footwear of claim 1, wherein the plate defines a through hole extending through the plate from a foot-facing surface of the plate to a ground-facing surface of the plate at the heel portion of the plate.

8. The article of footwear of claim 7, wherein the sole structure further includes a midsole layer underlying the plate at the through hole.

9. The article of footwear of claim 1, wherein the sole structure further includes a bladder defining a sealed, fluid-filled chamber underlying the forefoot portion of the plate.

10. The article of footwear of claim 9, wherein the sole structure further includes a midsole layer underlying the plate; and wherein the midsole layer is disposed between the plate and the bladder.

11. The article of footwear of claim 1, wherein the sole structure further includes a toe support extending over a foot-facing surface of the extension portion and having a wall extending upward along the foremost extent of the upper.

12. The article of footwear of claim 11, wherein the wall of the toe support further extends along a medial side of the upper in a forefoot region of the article of footwear and along a lateral side of the upper in the forefoot region of the article of footwear.

13. The article of footwear of claim 12, wherein the toe support extends further rearward along the lateral side of the upper than along the medial side of the upper.

14. The article of footwear of claim 11, wherein the toe support extends further forward than the extension portion of the plate.

15. The article of footwear of claim 11, wherein a foot-facing surface of the toe support extends seamlessly from a foot-facing surface of the forefoot portion of the plate.

16. The article of footwear of claim 1, further comprising:

a strobel that includes:

a bladder that defines a sealed, fluid-filled chamber in a forefoot region of the article of footwear, the bladder overlying the plate; and a lasting component secured to the upper and to the bladder and extending in a midfoot region and a heel region of the article of footwear.

17. The article of footwear of claim 1, wherein the plate includes a first plate layer extending in each of the heel portion, the midfoot portion, the forefoot portion, and the extension portion, and a second plate layer interfacing with the first plate layer and extending in the forefoot portion and the extension portion;

wherein a bending stiffness of the second plate layer is greater than a bending stiffness of the first plate layer;

wherein the first plate layer defines a recess in a ground-facing surface of the first plate layer such that the first plate layer is thinner at the recess than rearward of the recess; and wherein the second plate layer is nested in the recess of the first plate layer.

18. The article of footwear of claim 17, wherein the recess has a perimeter with a closed shape entirely on the ground-facing surface of the first plate layer, the second plate layer has a perimeter with a closed shape that matches the closed shape of the perimeter of the first plate layer;

wherein the first plate layer extends transversely outward of the second plate layer at a medial side of the recess and at a lateral side of the recess, and extends forward of the second plate layer forward of the recess and rearward of the second plate layer rearward of the recess; and wherein the ground-facing surface of the first plate layer and the ground-facing surface of the second plate layer together define a ground-facing surface of the plate.

19. The article of footwear of claim 17, wherein the first plate layer comprises a first material and the second plate layer comprises a second material different than the first material.

20. The article of footwear of claim 19, wherein the second plate layer is a composite material including carbon fibers, the second plate layer has a uniform thickness, and a longitudinal midline of the second plate layer is the same as the longitudinal midline of the article of footwear.

* * * * *